US007571882B2

(12) United States Patent
Walter

(10) Patent No.: US 7,571,882 B2
(45) Date of Patent: Aug. 11, 2009

(54) SUSPENSION DEVICE COMPRISING A PROFILE RAIL THAT IS TO BE VERTICALLY ARRANGED, AND COMPRISING A BRACKET THAT CAN BE SUSPENDED THEREIN

(75) Inventor: Herbert Walter, Müllheim (DE)

(73) Assignee: Visplay International AG, Muttenz (CH)

( * ) Notice: Subject to any disclaimer, the term of this patent is extended or adjusted under 35 U.S.C. 154(b) by 433 days.

(21) Appl. No.: 10/495,296

(22) PCT Filed: Nov. 14, 2002

(86) PCT No.: PCT/CH02/00612

§ 371 (c)(1),
(2), (4) Date: Oct. 14, 2004

(87) PCT Pub. No.: WO03/041540

PCT Pub. Date: May 22, 2003

(65) Prior Publication Data

US 2005/0040301 A1 Feb. 24, 2005

(30) Foreign Application Priority Data

Nov. 15, 2001 (CH) ..... 2105/01

(51) Int. Cl.
*A47G 29/02* (2006.01)
*E04G 3/08* (2006.01)
*E06B 7/28* (2006.01)

(52) U.S. Cl. ..... 248/235; 248/218.4; 248/220.21

(58) Field of Classification Search ..... 248/220.11, 248/220.31, 220.41, 235, 239, 241, 243, 248/245, 125.8, 157, 423, 218.4, 220.21; 211/193, 190, 189, 191, 192; 135/75, 65; 403/109.3, 107, 108

See application file for complete search history.

(56) References Cited

U.S. PATENT DOCUMENTS 2,026,223 A * 12/1935 Donnelly et al. ..... 108/109
2,229,473 A * 1/1941 Redmer ..... 248/188.5
2,872,144 A * 2/1959 Hobson ..... 248/223.41
3,512,654 A * 5/1970 Jay et al. ..... 211/193
RE27,200 E * 10/1971 Ferdinand et al. ..... 211/190

(Continued)

FOREIGN PATENT DOCUMENTS

DE 200 09 028 U1 9/2000

(Continued)

*Primary Examiner*—Amy J. Sterling
(74) *Attorney, Agent, or Firm*—McCarter & English, LLP

(57) ABSTRACT

The suspension device firstly consists of a profile (1) to be vertically arranged and having engaging contours (3), which are provided thereon and located opposite one another, preferably in pairs, on both lateral flanks. The profile (1) is fixed to a supporting structure. The inventive device comprises at least one bracket (2), which can be suspended in the profile (1) and has fixing elements that are complementary to the engaging contours (3). The bracket (2) has an enclosing part (20) on which or inside of which the fixing elements are placed. The front side (10) and both lateral flanks of the profile (1) are surrounded by the bracket (2) that enables it to be joined to differently configured load-bearing elements (4). The bracket (2) can be locked at the level of the selected engaging contours (3). The suspension device is provided in a number of variants and is designed, for example, for use as an information and decoration support in reception areas or as a stand for presenting goods or exhibited articles or for storing objects. The profile (1) is provided in the form of bars or short pieces having at least one pair of engaging contours (3).

8 Claims, 23 Drawing Sheets

U.S. PATENT DOCUMENTS

| | | | | | |
|---|---|---|---|---|---|
| 3,794,183 | A | * | 2/1974 | Colbridge | 211/208 |
| 3,854,686 | A | * | 12/1974 | Konstant | 248/243 |
| 4,205,629 | A | * | 6/1980 | Wix | 119/51.5 |
| 4,348,989 | A | * | 9/1982 | Vik | 119/72 |
| 4,444,323 | A | * | 4/1984 | Travis | 211/193 |
| 4,553,726 | A | * | 11/1985 | Jackson | 248/297.11 |
| 4,595,383 | A | * | 6/1986 | Nienhaus | 464/162 |

FOREIGN PATENT DOCUMENTS

| | | | |
|---|---|---|---|
| DE | 100 35 359 | A1 | 2/2001 |
| DE | 201 00 181 | U1 | 7/2001 |
| EP | 0 716 825 | B1 | 3/1998 |
| FR | 945 260 | | 4/1949 |
| GB | 2 154 429 | A | 9/1985 |
| GB | 2 352 387 | A | 1/2001 |
| WO | WO 99/20094 | A2 | 4/1999 |
| WO | WO 99/20094 | A3 | 7/1999 |
| WO | WO 99/65368 | | 12/1999 |
| WO | WO 01/43599 | A1 | 6/2001 |
| WO | WO 01/8123 | A1 | 11/2001 |

* cited by examiner

Fig. 1C
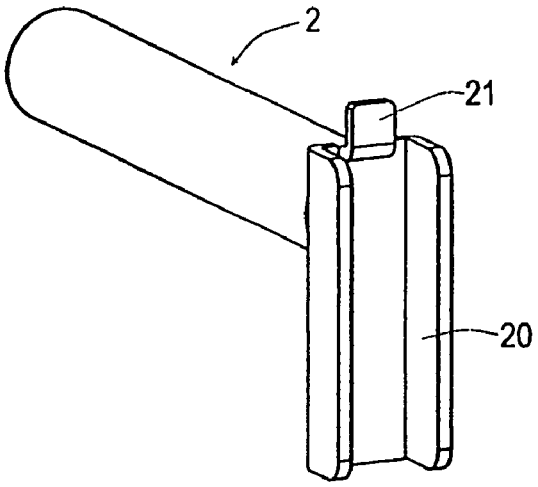
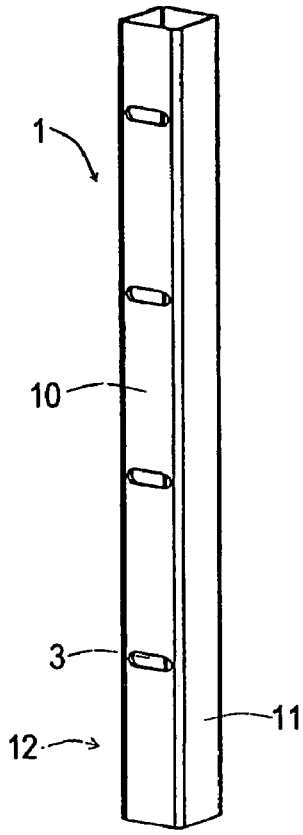
Fig. 1B
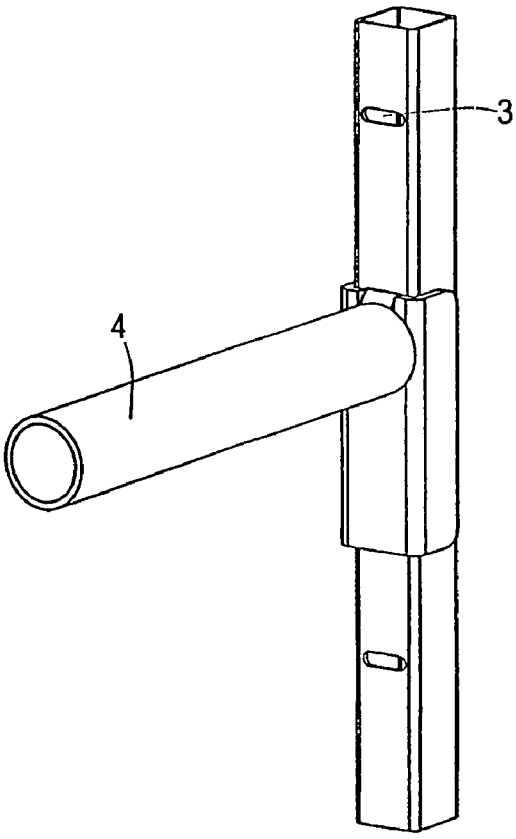
Fig. 1A

Fig. 3F
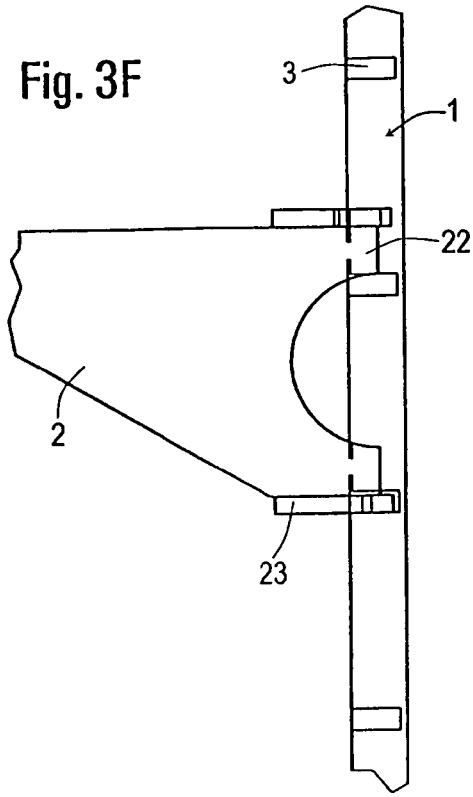
Fig. 3D
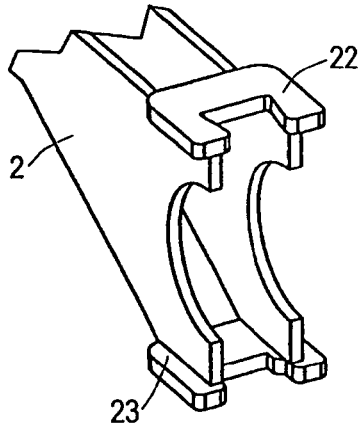
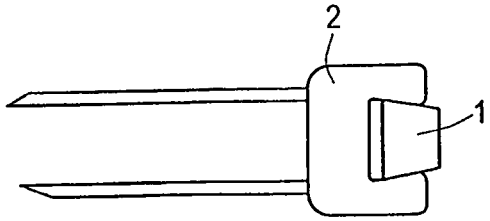
Fig. 3G
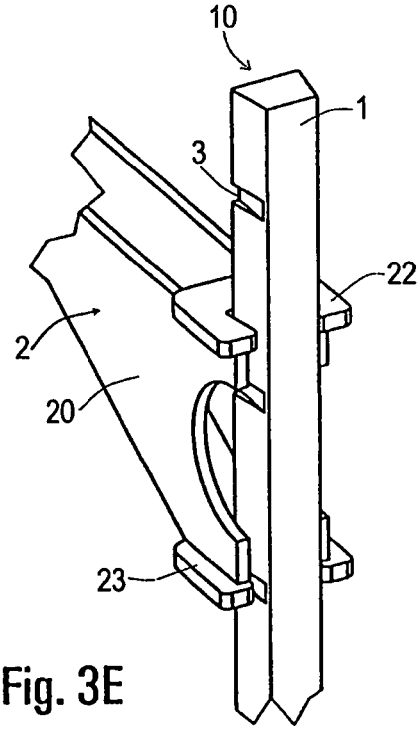
Fig. 3E

Fig. 6A
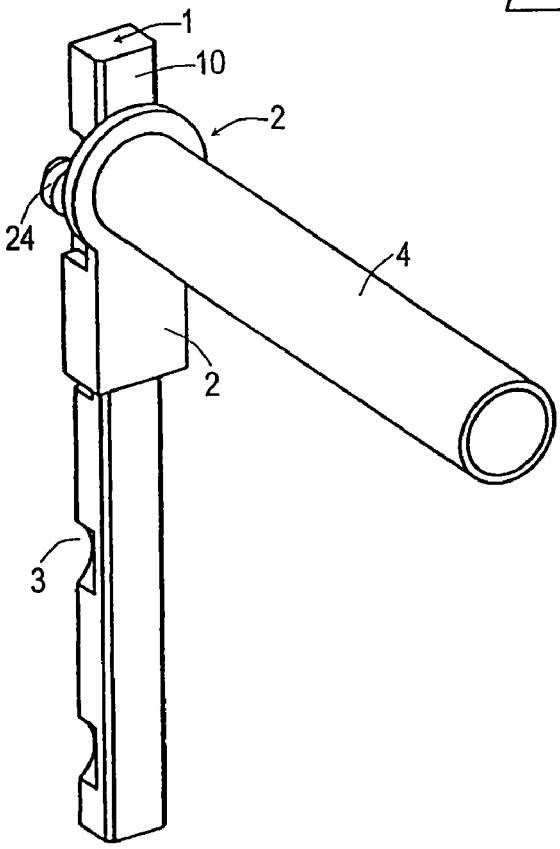
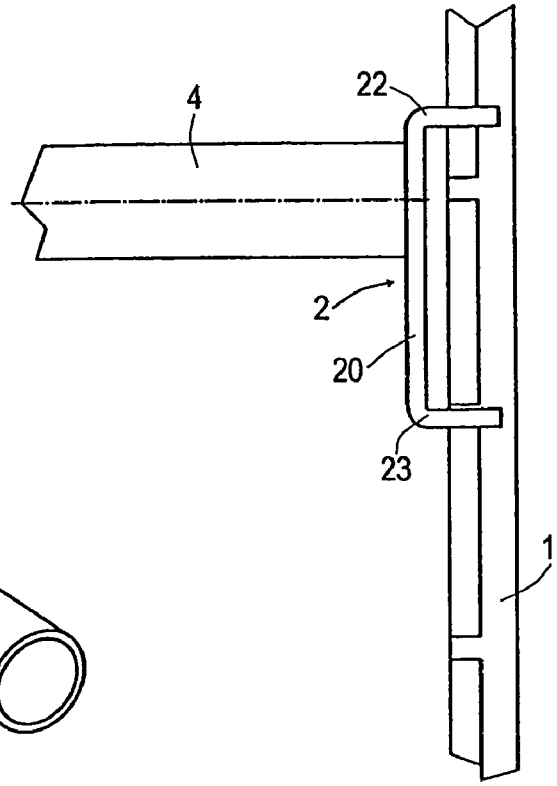
Fig. 5F
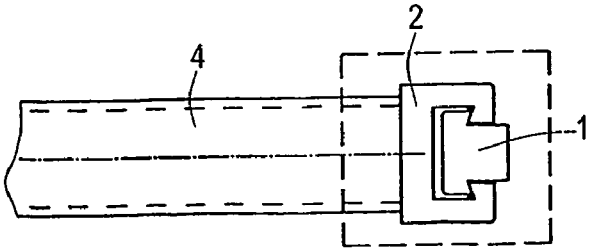
Fig. 5G
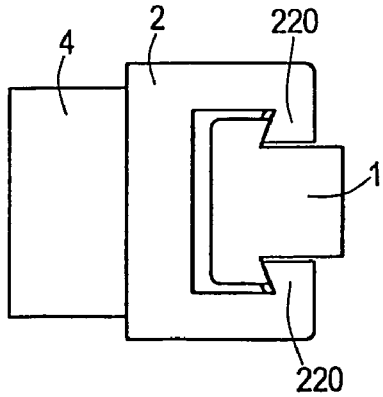
Fig. 5H

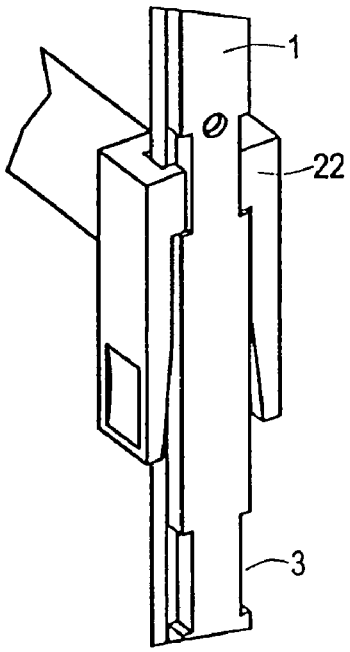
Fig. 9E
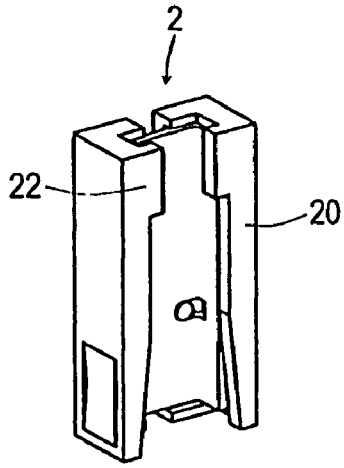
Fig. 9D
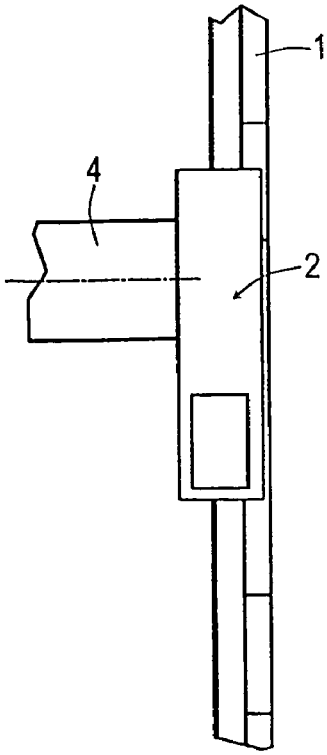
Fig. 9F
Fig. 9G
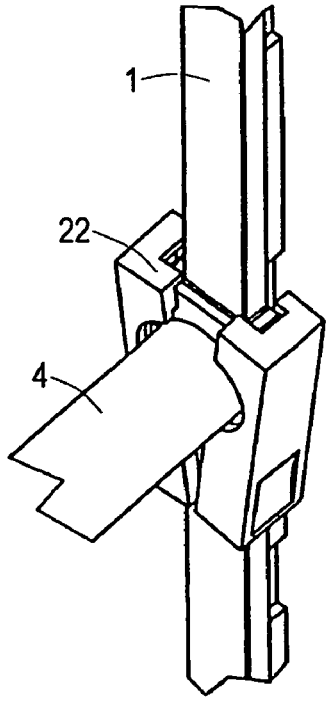

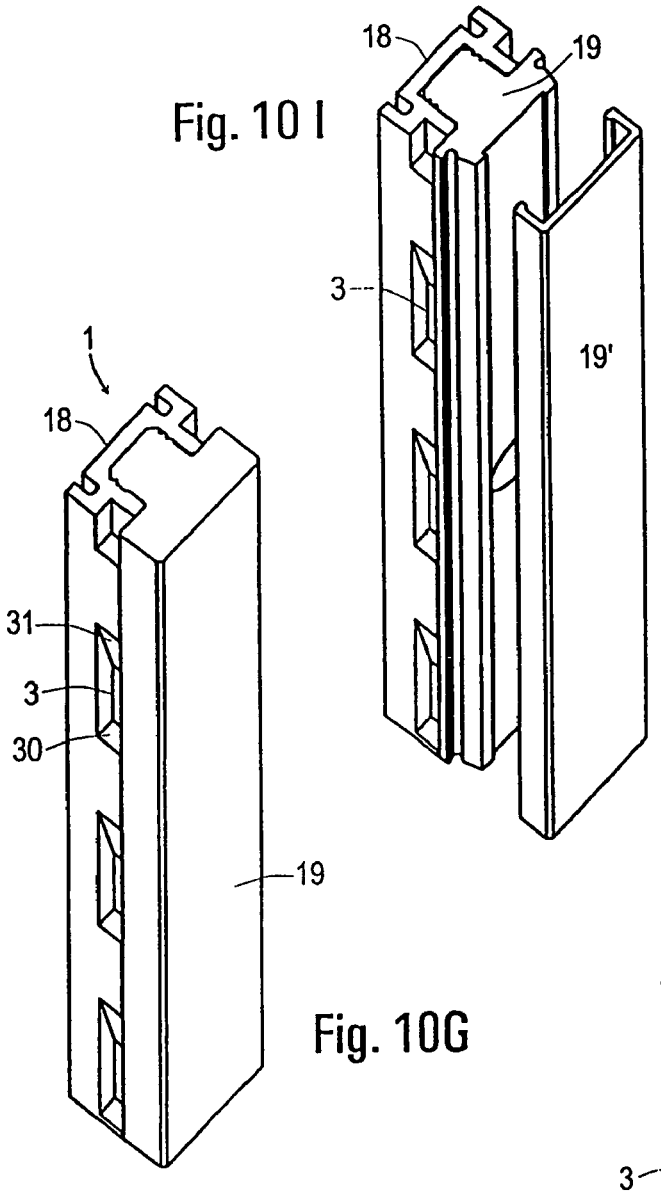
Fig. 10G
Fig. 10 I
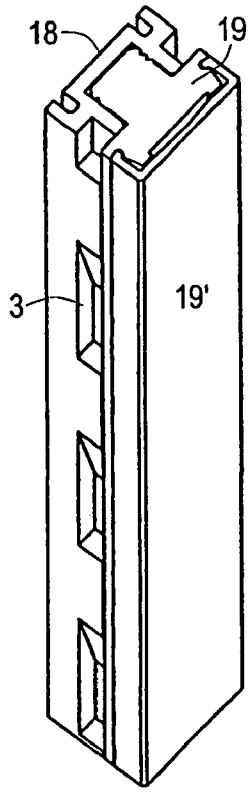
Fig. 10J
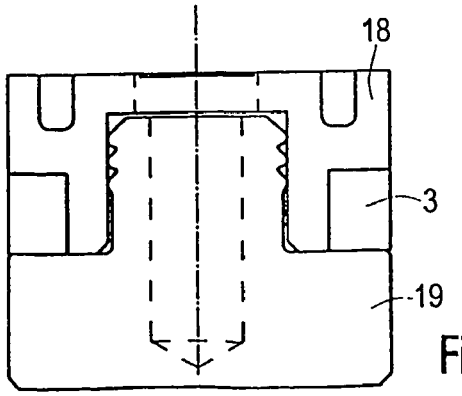
Fig. 10H
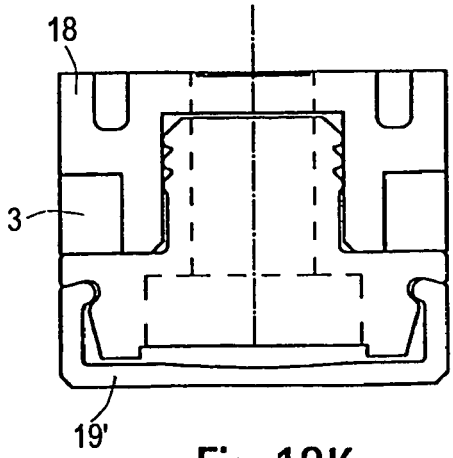
Fig. 10K

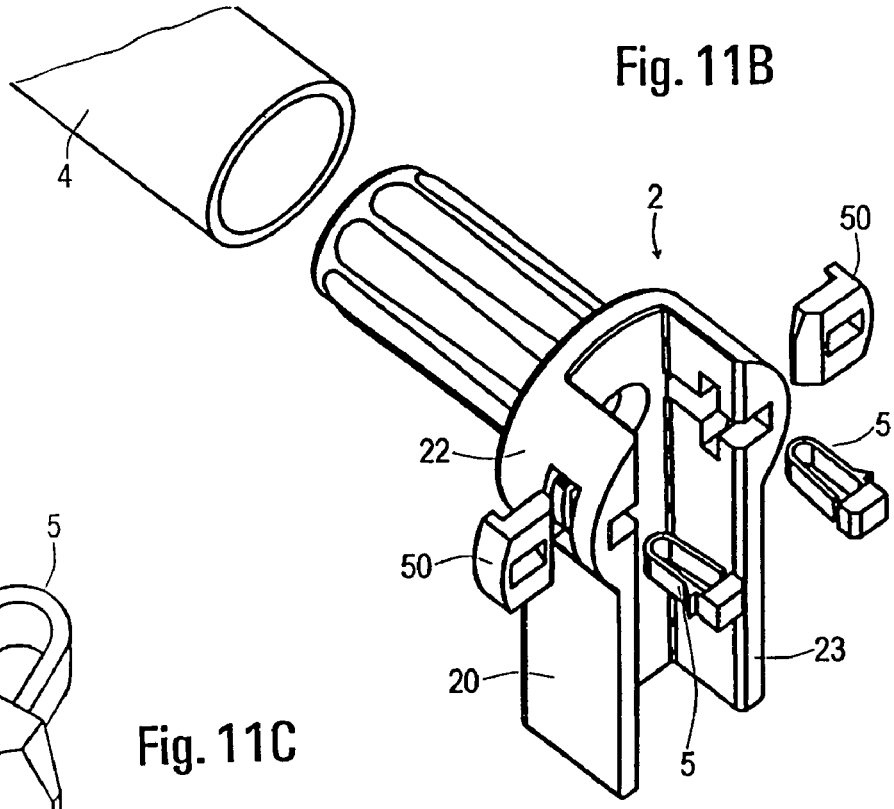
Fig. 11B
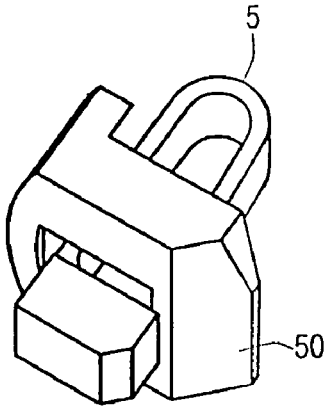
Fig. 11C
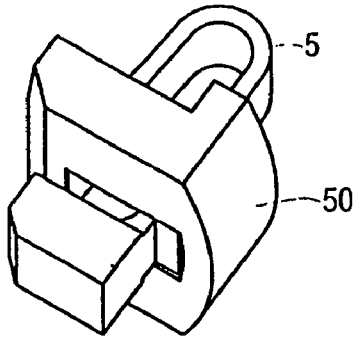
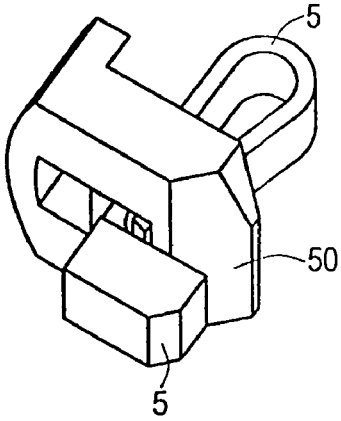
Fig. 11D
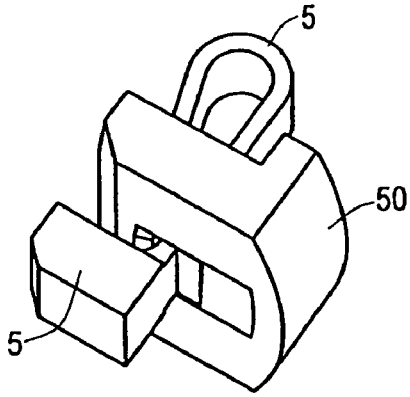

Fig. 14C
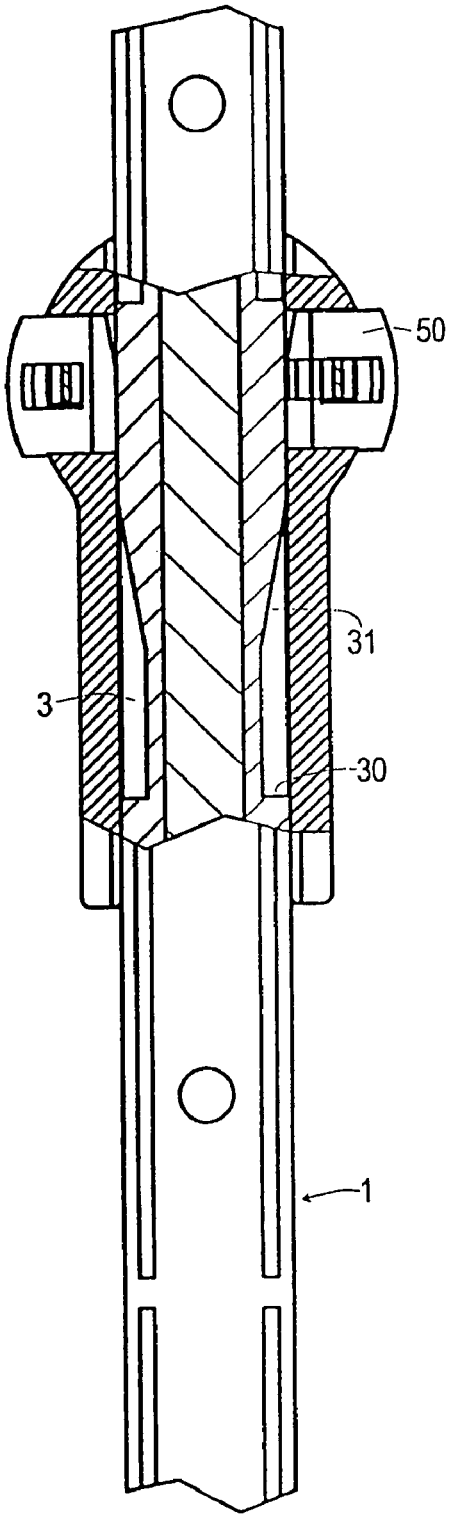
Fig. 14A
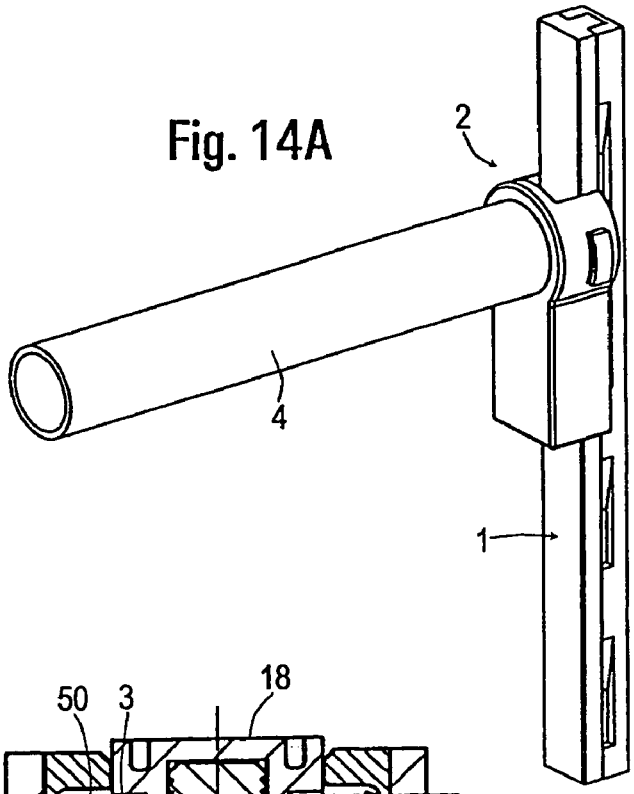
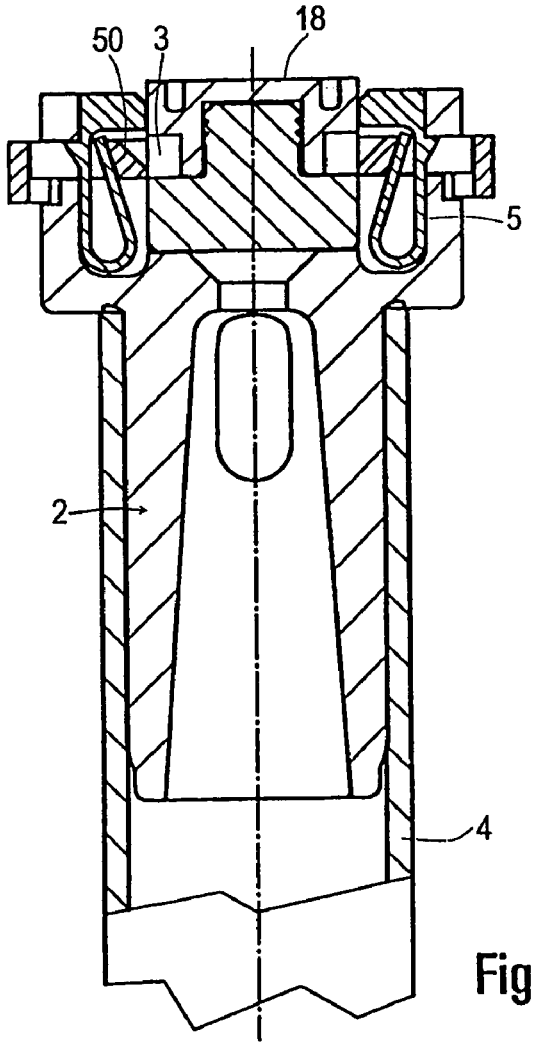
Fig. 14B

Fig. 15A
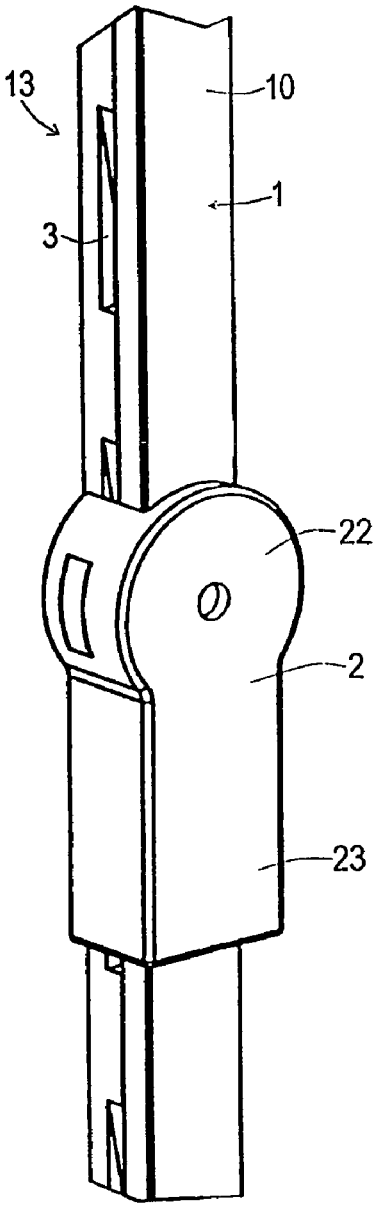
Fig. 15B
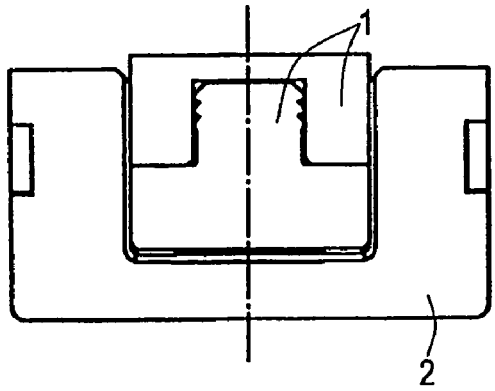
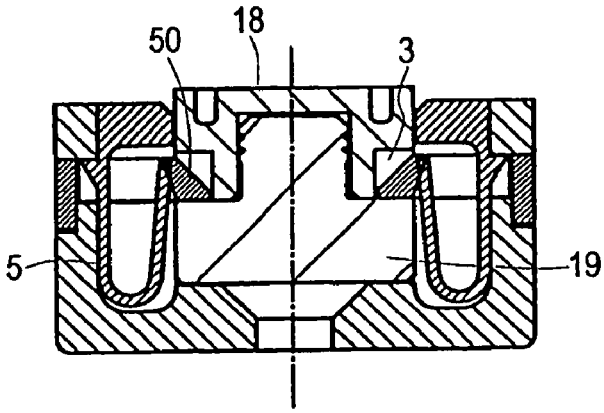
Fig. 15C

SUSPENSION DEVICE COMPRISING A PROFILE RAIL THAT IS TO BE VERTICALLY ARRANGED, AND COMPRISING A BRACKET THAT CAN BE SUSPENDED THEREIN

FIELD OF THE INVENTION

The present invention relates to a suspension device having a profile rail for arranging vertically on a carrying structure, e.g. a rear wall, a panel, a frame or a framework, and having a bracket which can be suspended in the profile rail. The profile rail has a grid arrangement in which it is possible to suspend the bracket, which is connected to a carrying arm, a crossbar or a shelf carrier. Structures which are formed by way of sections of the profile rail are used, for example, as information and decoration carriers in reception areas or as a framework for displaying goods or exhibits or for storing articles.

BACKGROUND OF THE INVENTION

A variety of devices for punctiform suspension are known (e.g. EP 0 716 825 B1; WO 99/20094; DE 201 09 028 U1). Suspension devices for the horizontally variable arrangement of carrying arms have likewise been proposed in a variety of configurations (e.g. WO 99/65368; WO 01/43599). Finally, a large number of variants of suspension devices for the vertically variable arrangement of profile rails and brackets which can be suspended therein are known (e.g. DE 201 00 181 U1).

OBJECT OF THE INVENTION

The devices known from the prior art have proven successful in the past. However, there is a need for perfection, i.e. increasing the stability, variability, ease of service and expediency, and for novel solutions which give rise to different possible configurations. In view of this, the object of the invention is to propose an improved and original suspension device which has an increased use value for the field of the invention defined above and comprises a profile rail for arranging vertically on a carrying structure and also a bracket which can be suspended in the profile rail. The intention is for it to be possible for a plurality of brackets to be suspended at different heights on a profile rail, for the brackets to be connected to differently configured load carriers, and for the profile rail to be arranged both in vertical lines, in differing lengths depending on the local conditions, and as short sections.

SUMMARY OF THE INVENTION

The suspension device comprises, in the first instance, a profile which is to be arranged vertically and has a front side, two side flanks and a rear side and also engagement contours provided on the profile. The device also contains a bracket which can be suspended on the profile and has fixing elements which are complementary to the engagement contours. The bracket has an encompassing part on which or in which the fixing elements are arranged, and, in the suspended state, encases the front side and the two side flanks of the profile.

The following features relate to specific configurations and variants of the invention: The fixing elements are arranged on a clamp portion of the encompassing part of the bracket, e.g. as fixed elements. As an alternative, at least, and preferably, one removable fixing element is provided. In further alternatives, the fixing elements provided are spring-mounted or inherently elastic. It is possible for the engagement contours in the profile to be located on the rear side or front side of the profile, to be arranged in the side flanks of the profile and to extend to the front side of the profile or to be undercut in relation to the front side.

In one configuration, the profile is T-shaped in cross section with a rearwardly directed profile base, and the transverse leg of the profile forms the front side. This results in two longitudinally running undercuts behind the front side, these undercuts preferably being provided with a grid as engagement contours—e.g. in the form of notches, holes or outwardly oriented punched-out portions. A top clamp portion and a bottom supporting portion are provided on the encompassing part of the bracket, the clamp portion, as fixing element, having hooks which are offset in height in relation to one another. The bracket can only be attached in a twisted state to the profile, as a result of which the clamp portion passes over the front side and, once rotated into the straightened position, engages behind the front side and, finally, moves into the engagement contours.

In further configurations, the profile is trapezoidal or T-shaped in cross section, the wider, front side being at the front, and a mutually symmetrical grid of slots, which is accessible from the front side, being arranged in each case as engagement contours in the side flanks, this producing pairs of slots located at the same height. A top clamp portion and a bottom supporting portion are provided on the encompassing part of the bracket, the portions having fork-like openings which are directed toward the profile and equal the span between a pair of slots, and being spaced apart from one another by a distance which is not congruent with the distance between different pairs of slots of the grid. The fixing elements are formed by claws on the clamp portion. In the suspended state, the top clamp portion encases the profile outside a pair of slots and thus restains the bracket, while the bottom supporting portion, pushed into a pair of slots, supports the bracket vertically.

In the next configuration, the profile is quadrilateral in cross section, a grid of semicircular notches which is undercut in relation to the front side being provided as engagement contours on the side flanks. The two side flanks are symmetrical to one another, this resulting in pairs of notches located at the same height in each case. A bottom supporting portion and a top clamp portion with securing plates suspended in a moveable manner as fixing elements are provided on the encompassing part of the bracket. The securing plates are spring-mounted and/or eccentric and, in the suspended state of the bracket, in the rest position, thus move toward one another and engage in a selected pair of notches. The securing plates are contoured, in order that they remain in the selected pair of notches even when the suspended bracket is subjected to increasing load.

In another configuration, the profile is basically quadrilateral in cross section, a grid of preferably rectangular or polygonal slots which is undercut in relation to the front side being provided as engagement contours on the side flanks; the two side flanks are symmetrical to one another, and this results in pairs of slots located at the same height in each case. The encompassing part of the bracket is designed as a spring-stressed gripper, which has two jaws and can be opened counter to the spring stressing, and the encompassing part has mutually facing noses as fixing elements on its clamp portion. In the suspended state of the bracket, the encompassing part engages around the profile, and the spring stressing forces the noses into a selected pair of slots, as a result of which the bracket is secured on the profile. The gripper jaws are mounted in a rotatable manner on vertical or horizontal pins. The profile can advantageously be joined together from a rear strip, which forms the rear side and contains the grid of slots, and a front strip, which forms the front side and covers over the grid of slots toward the front.

In a specific configuration, the engagement contours are designed as undercut, wedge-shaped slots in the side flanks, have a ledge at the bottom and slope up gradually, preferably in a slanting plane, to the plane of the side flanks. The engagement contours on one side flank are arranged symmetrically in relation to the engagement contours on the other side flank. The fixing elements in the bracket are constituted in each case by a wedge mounted on a spring, in each case one spring and one wedge being provided on either side of an aperture accommodating the profile. The springs and the wedges, inserted in cutouts, secure one another. The profile can be made up of a rear strip, which contains the engagement contours and is preferably made of plastic, and of a front strip. The profile is used as bar material or in short lengths with at least one pair of engagement contours.

In an additional configuration, the profile is rectangular in cross section, a grid of slots with horizontal through-slots being located as engagement contours on the rear side. A bottom supporting portion and a top clamp portion with a transversely insertable securing pin as fixing element are provided on the encompassing part of the bracket. In the suspended state, the securing pin, located in the selected slot, holds the bracket in position.

Finally, a configuration with a hollow profile bar in which the engagement contours are formed as slots in the front side of the profile, and the fixing element is a tongue which fits into the slots, is proposed. The tongue is located on the top edge of the encompassing part, initially extends horizontally in the direction of the profile, and terminates with an upright section.

The invention, then, provides different variants of a novel suspension device having a profile rail which is to be arranged vertically and, depending on the length to which it is cut, a plurality of brackets which can be suspended therein. This gives rise to further-reaching, original possible configurations along with efficient production and assembly costs.

BRIEF DESCRIPTION OF THE DRAWINGS

For a more complete understanding of the present invention, reference is made to the following detailed description of exemplary embodiments considered in conjunction with the accompanying drawings, in which:

FIG. 1A shows a perspective illustration of a first variant of a suspension device according to the invention having a hollow profile, which has a grid of slots on its front side, and an associated bracket, in the suspended state;

FIG. 1B shows the hollow profile according to FIG. 1A;

FIG. 1C shows the bracket according to FIG. 1A;

FIG. 3D shows the bracket according to FIG. 3A;

FIG. 3E shows a perspective view from the rear of the arrangement according to FIG. 3A;

FIG. 3F shows a side view of the arrangement according to FIG. 3A;

FIG. 3G shows a plan view of the arrangement according to FIG. 3A;

FIG. 5F shows a side view of the arrangement according to FIG. 5A;

FIG. 5G shows a plan view of the arrangement according to FIG. 5A;

FIG. 5H shows an enlargement from FIG. 5G;

FIG. 6A shows a perspective illustration of a sixth variant of the suspension device, having a profile provided with a lateral, undercut grid of slots and having an associated bracket, in the suspended state;

FIG. 9D shows the bracket according to FIG. 9A;

FIG. 9E shows a perspective view from the rear of the arrangement according to FIG. 9A;

FIG. 9F shows a side view of the arrangement according to FIG. 9A;

FIG. 9G shows the arrangement according to FIG. 9A with the bracket disengaged from the profile;

FIG. 10G shows the profile according to FIG. 10A for a screw connection at the rear;

FIG. 10H shows an enlarged horizontal cross section of the profile according to FIG. 10G;

FIG. 10I shows the profile according to FIG. 10A for a screw connection at the front, with the covering released;

FIG. 10J shows the arrangement according to FIG. 10I with the covering latched onto the profile;

FIG. 10K shows an enlarged horizontal cross section of the profile according to FIG. 10J;

FIG. 11B shows an exploded illustration of the bracket according to FIG. 11A;

FIG. 11C shows the position of the springs and wedges from the bracket according to FIG. 11A; with the bracket engaged in the profile;

FIG. 11D shows the position of the springs and wedges from the bracket according to FIG. 11A, with the bracket in the free position on the profile;

FIG. 14A shows a perspective illustration of the arrangement according to FIG. 10A in the free position;

FIG. 14B shows an enlarged horizontal section of the arrangement according to FIG. 14A;

FIG. 14C shows an enlarged vertical section of the arrangement according to FIG. 14A;

FIG. 15A shows a perspective illustration of the arrangement according to FIG. 10A with a universal bracket, in the latching position;

FIG. 15B shows a plan view of the arrangement according to FIG. 15A;

FIG. 15C shows an enlarged horizontal section of the arrangement according to FIG. 15A;

EXEMPLARY EMBODIMENTS

Figure 1D:
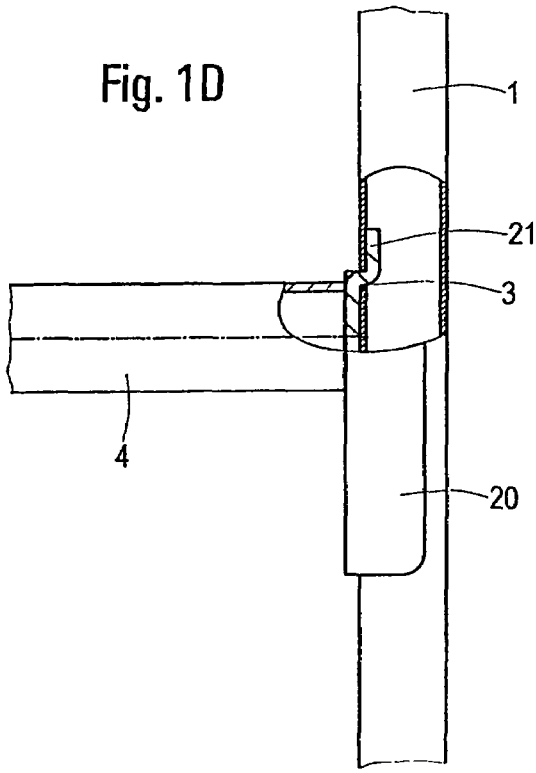
FIG. 1D shows a partial section from FIG. 1A in the region where the bracket engages in the profile.
Figure 2B:
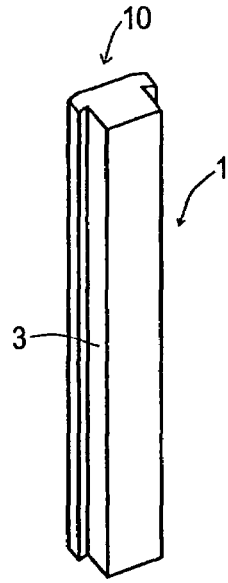
FIG. 2B shows the profile according to FIG. 2A.
Figure 2A:
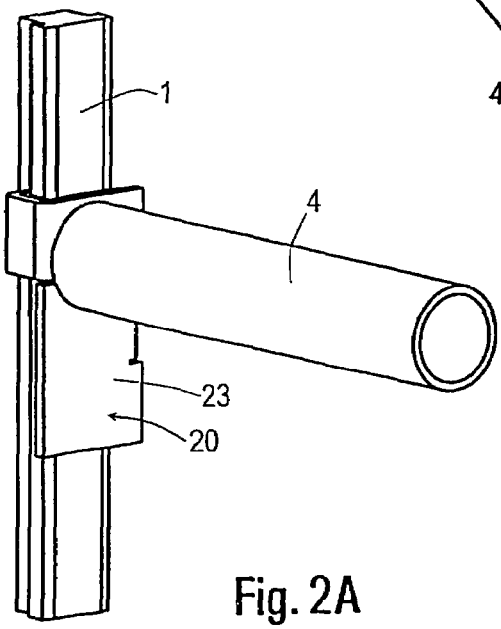
FIG. 2A shows a perspective illustration of a second variant of the suspension device, having a modified profile and bracket, in the suspended state.
Figure 2C:
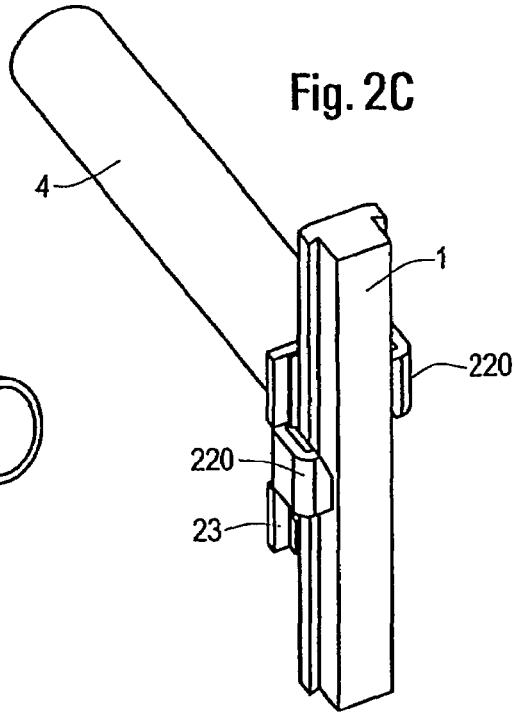
FIG. 2C shows a perspective view from the rear of the arrangement according to FIG. 2A.
Figure 2D:
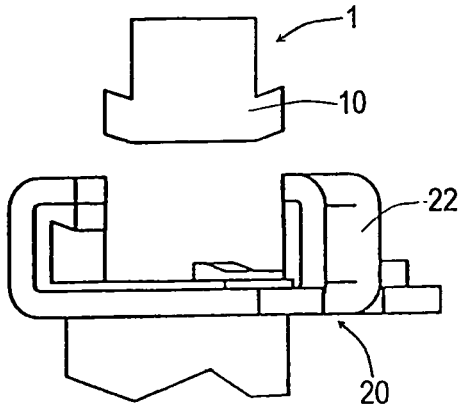
FIG. 2D shows a plan view of the bracket according to FIG. 2A moving toward the profile according to FIG. 2A.
Figure 2E:
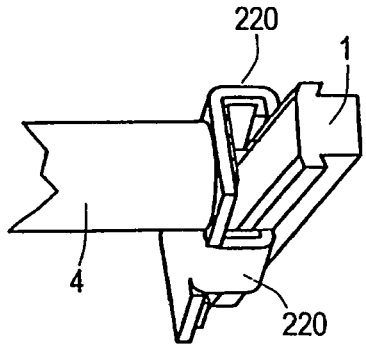
FIG. 2E shows the operation of suspending the bracket according to FIG. 2A in the profile according to FIG. 2A.
Figure 2G:
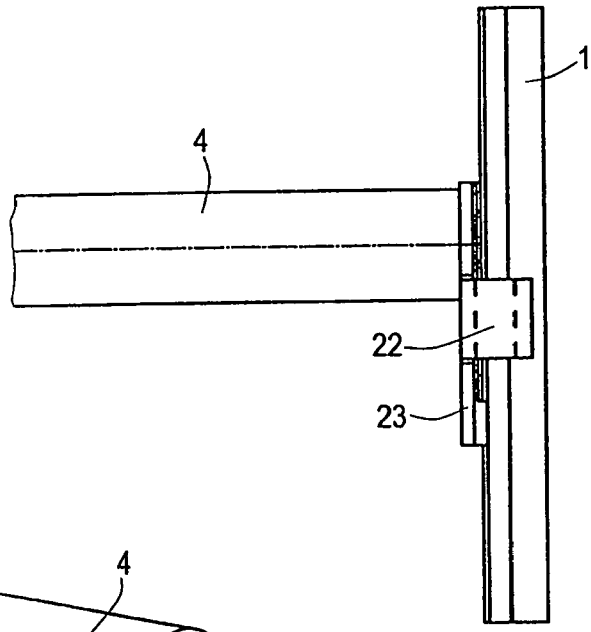
FIG. 2G shows a side view of the arrangement according to FIG. 2A.
Figure 2F:
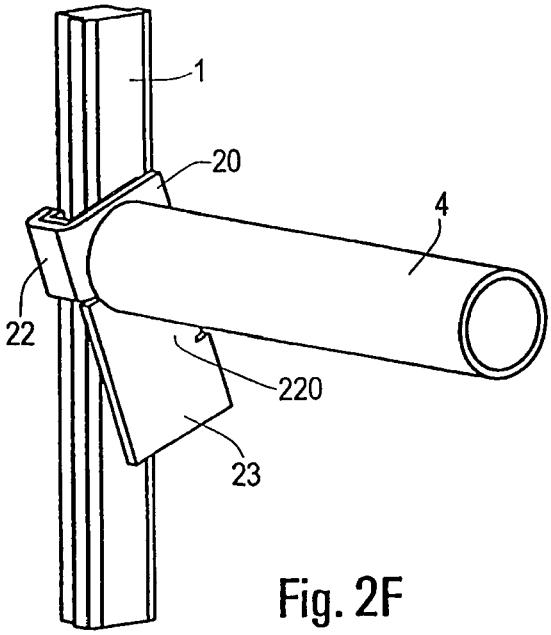
FIG. 2F shows a different perspective view of the arrangement according to FIG. 2E.
Figure 2H:
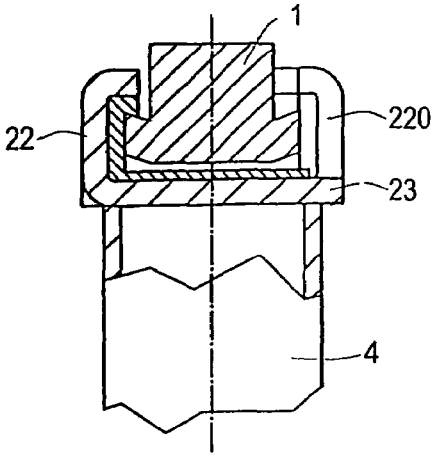
FIG. 2H shows an enlarged horizontal section of the suspended state according to FIG. 2A.
Figure 3A:
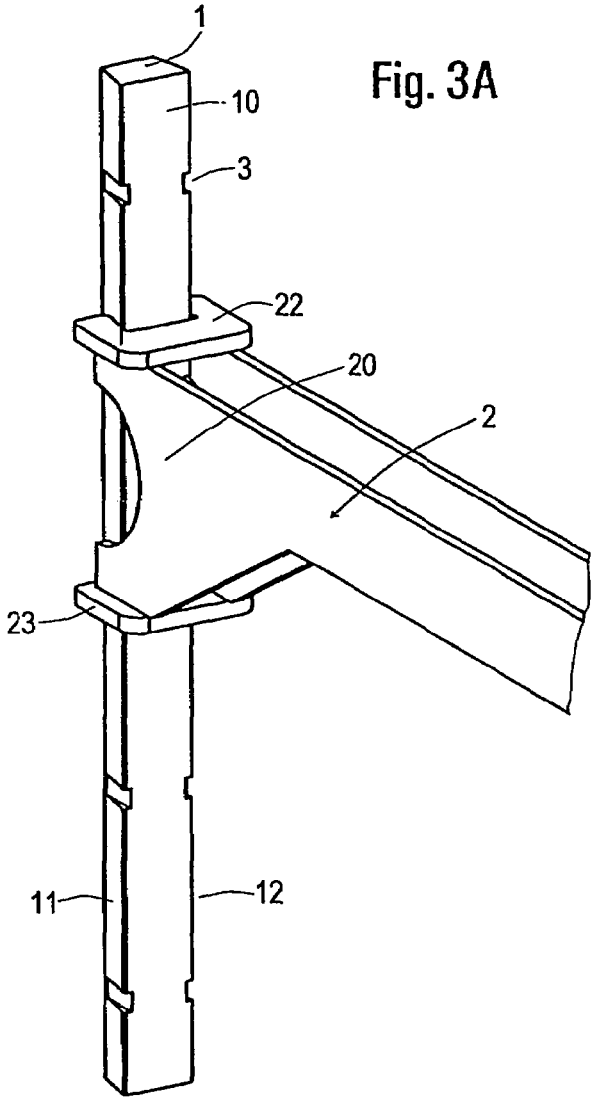
FIG. 3A shows a perspective illustration of a third variant of the suspension device, having a cross-sectionally trapezoidal profile and an associated bracket, in the suspended state.
Figure 3B:
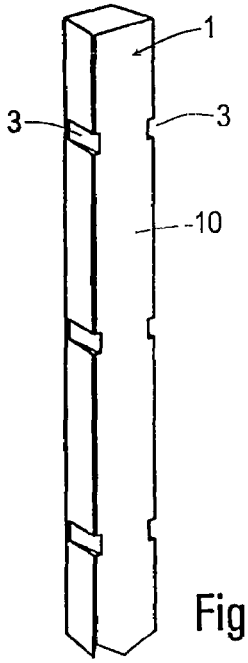
FIG. 3B shows the profile according to FIG. 3A.
Figure 3C:
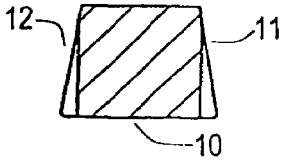
FIG. 3C shows the profile according to FIG. 3A in horizontal section.
Figure 4A:
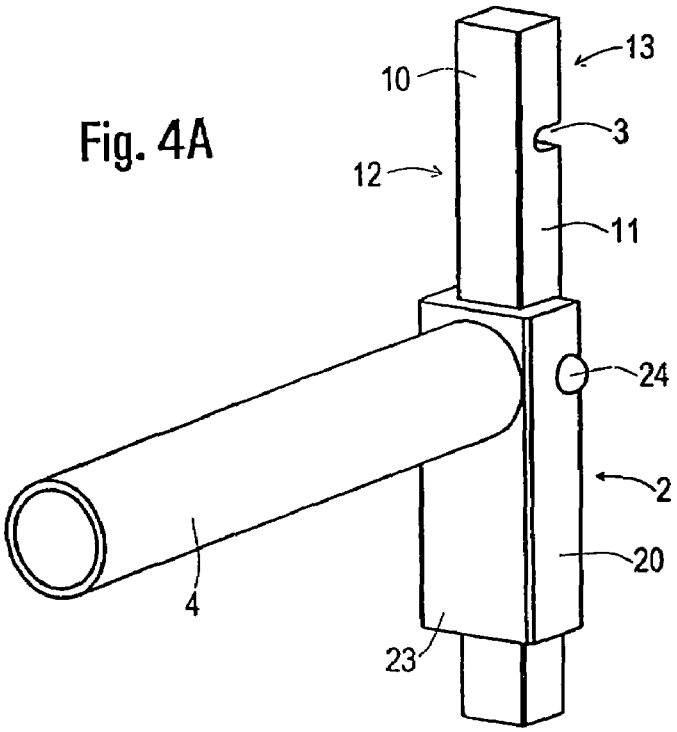
FIG. 4A shows a perspective illustration of a fourth variant of the suspension device, having a profile with a grid of slots on the rear side and having an associated bracket, in the suspended state.
Figure 4B:
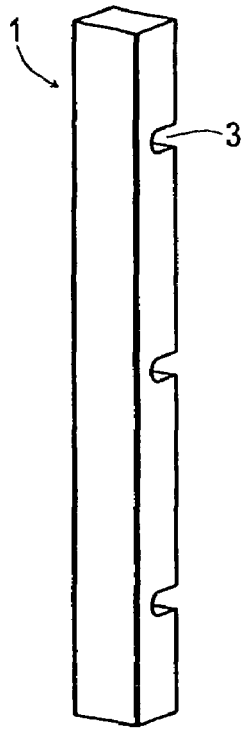
FIG. 4B shows the profile according to FIG. 4A.
Figure 4C:
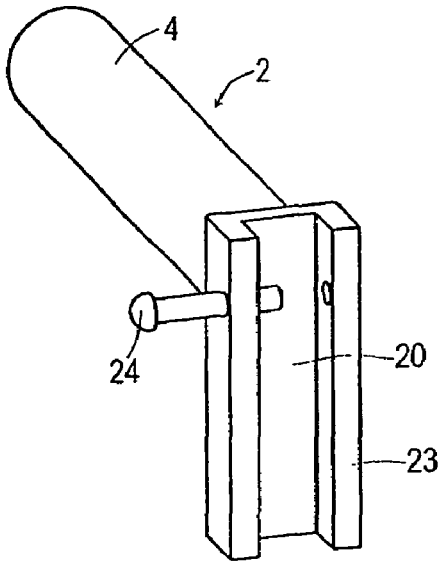
FIG. 4C shows the bracket according to FIG. 4A.
Figure 4D:
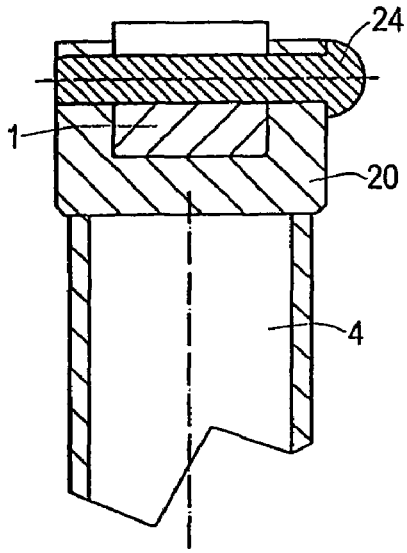
FIG. 4D shows an enlarged horizontal section of the arrangement according to FIG. 4A.
Figure 5A:
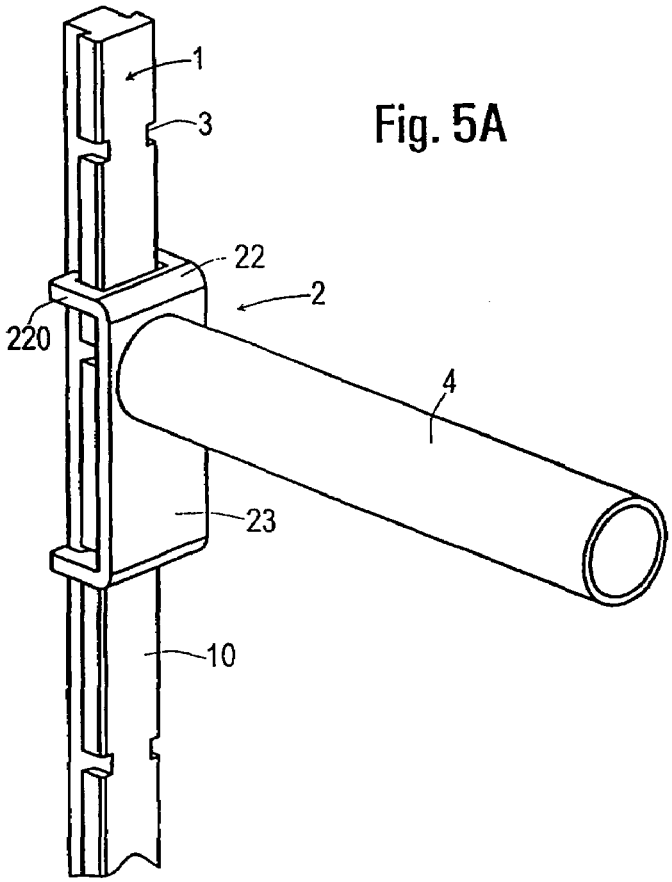
FIG. 5A shows a perspective illustration of a fifth variant of the suspension device, having a cross-sectionally T-shaped profile provided with a lateral grid of slots and having an associated bracket, in the suspended state.
Figure 5B:
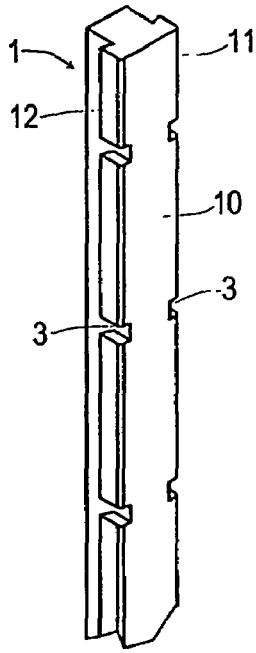
FIG. 5B shows the profile according to FIG. 5A.
Figure 5C:
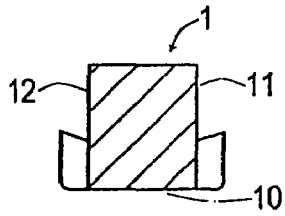
FIG. 5C shows the profile according to FIG. 5A in horizontal section.
Figure 5E:
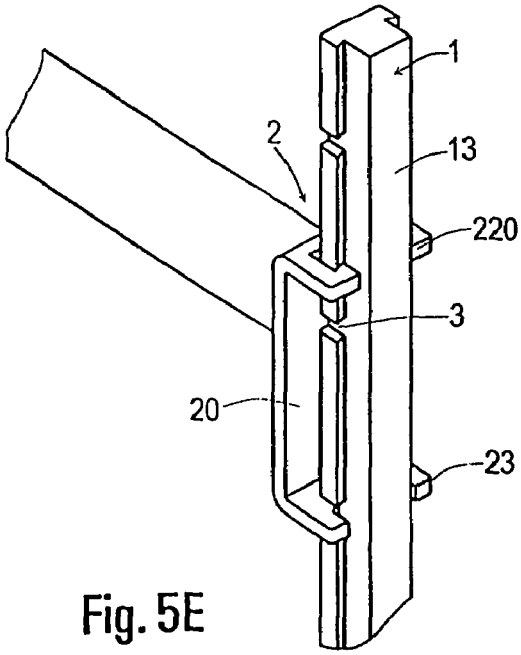
FIG. 5E shows a perspective view from the rear of the arrangement according to FIG. 5A.
Figure 5D:
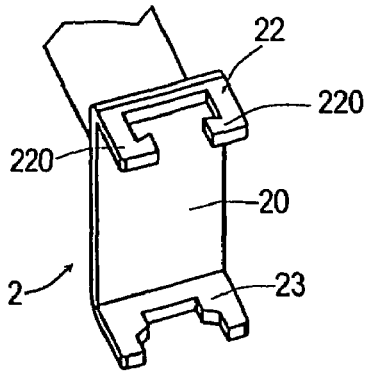
FIG. 5D shows the bracket according to FIG. 5A.
Figure 6B:
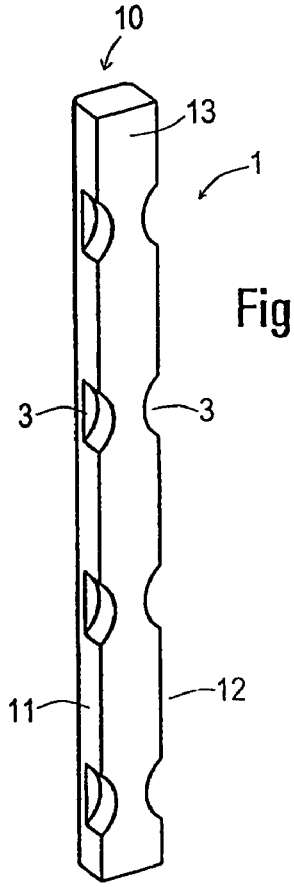
FIG. 6B shows the profile according to FIG. 6A.
Figure 6C:
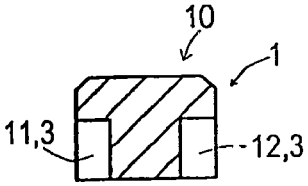
FIG. 6C shows the profile according to FIG. 6A in horizontal section.
Figure 6D:
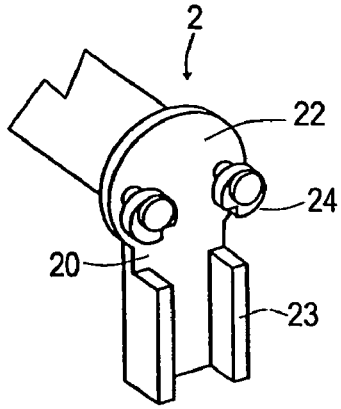
FIG. 6D shows the bracket according to FIG. 6A.
Figure 6E:
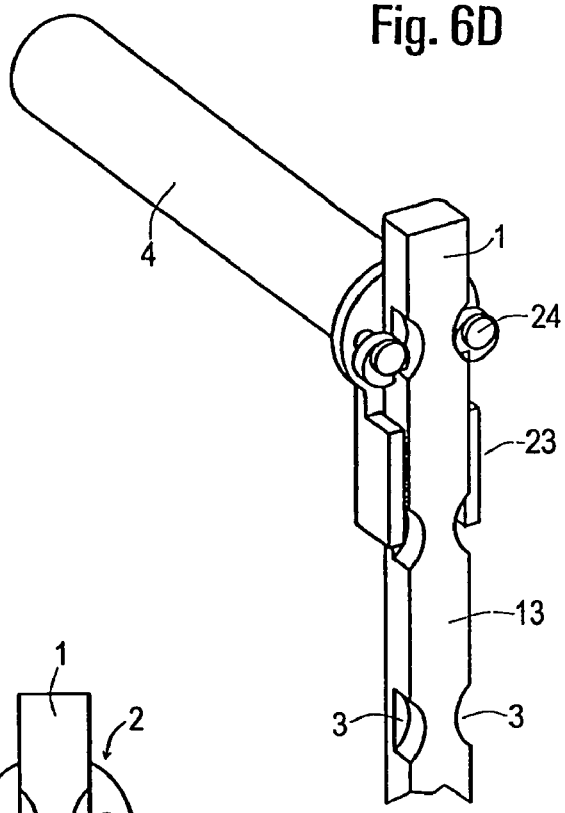
FIG. 6E shows a perspective view from the rear of the arrangement according to FIG. 6A.
Figure 6F:
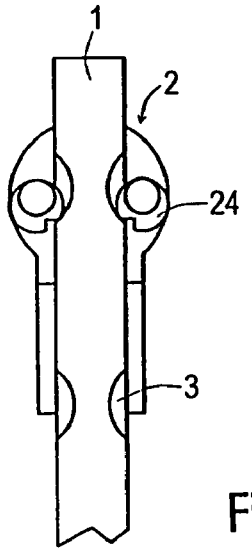
FIG. 6F shows a rear view of the arrangement according to FIG. 6A.
Figure 7A:
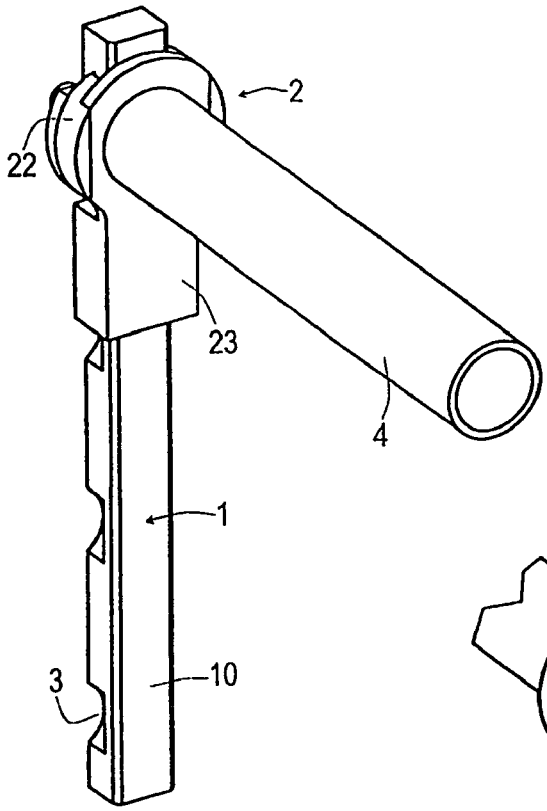
FIG. 7A shows a perspective illustration of a seventh variant of the suspension device, having the profile of the sixth variant and a modified bracket, in the suspended state.
Figure 7C:
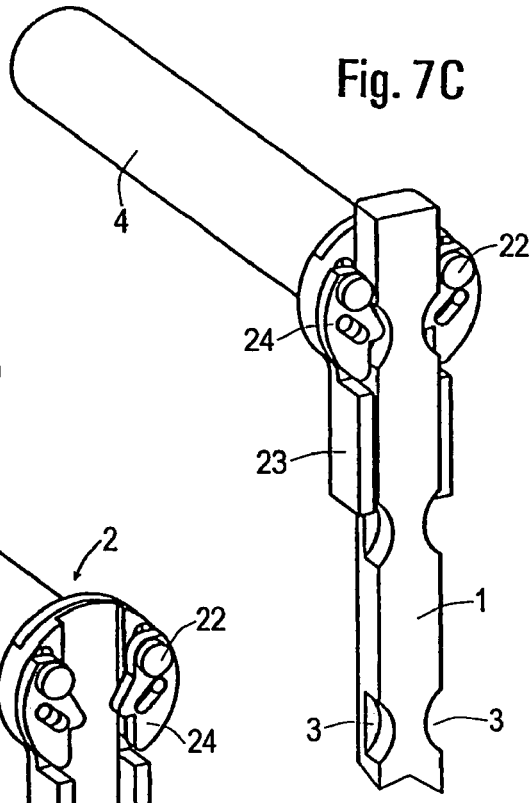
FIG. 7C shows a perspective view from the rear of the arrangement according to FIG. 7A.
Figure 7B:
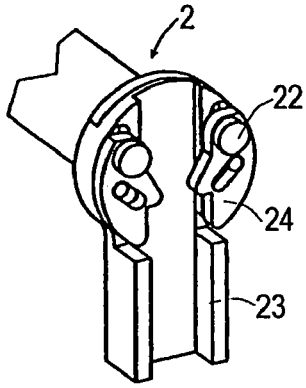
FIG. 7B shows the bracket according to FIG. 7A.
Figure 7D:
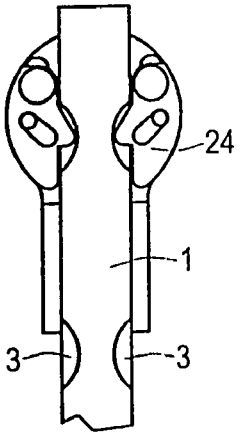
FIG. 7D shows a rear view of the arrangement according to FIG. 7A.
Figure 7F:
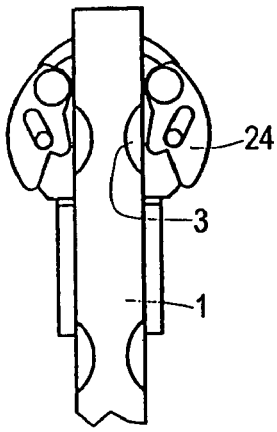
FIG. 7F shows the arrangement according to FIG. 7A with the bracket disengaged from the profile.
Figure 7E:
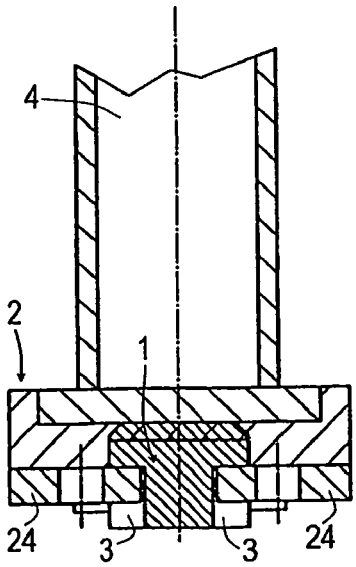
FIG. 7E shows the arrangement according to FIG. 7A in horizontal section.

With reference to the attached drawings, the detailed description of exemplary embodiments of the suspension device according to the invention, in various modifications, will be given hereinbelow.

The following applies to the rest of the description. If, in order to avoid ambiguity in the drawings, a Figure contains designations which are not explained in the directly associated text of the description, then you are referred to the point at which they are mentioned in previous descriptions of the Figures. For reasons of clarity, components are not usually designated again in subsequent Figures, provided that it is clear from the drawings that they are "recurring" components.

FIGS. 1A to 1C

In the first variant of the suspension device, use is made of a rectangular, hollow profile rail 1 which has a grid of slots 3 on its front side 10. The associated bracket 2 comprises a cross-sectionally U-shaped encompassing part 20, from which a tongue 21, which is initially angled in the direction of the profile rail 1, projects upward at the top. In the suspended state, the encompassing part 20 engages around the front side 10 and the two side flanks 11,12 of the profile rail 1, the tongue 21 projecting into the selected slot 3 and engaging behind the front side 10 on the inside. For suspending and releasing the bracket 2, the latter has to be angled in order for it to be possible for the tongue 21 to be introduced and removed. In this case, a straight carrying bar is attached, as load carrier 4, to the bracket 2. The encompassing part 20, which is U-shaped in horizontal cross section and is seated, as far as possible, in a play-free manner, on the front side 10 and the two side flanks 11,12, ensures laterally stable positioning of the suspended bracket 2 with the arm-like load carrier 4 extending therefrom.

FIGS. 2A to 2H

In a second variant of the suspension device, use is made of a T-shaped profile bar 1, of which the base is directed rearward and the transverse leg forms the front side 10. This results in two longitudinally running undercuts behind the front side 10, these undercuts preferably being provided with a grid 3, which may be formed by notches, holes or outwardly oriented punched-out portions. The associated bracket 2, once again, has an encompassing part 20 with a top clamp portion 22, with hooks 220 which are offset in height in relation to one another, and with a bottom supporting plate 23. In order to attach the bracket 2, the latter is twisted, with the result that its clamp portion 22 passes over the front side 10 and, once rotated into the straightened position, engages behind the front side 10 and, finally, moves into the grid 3 which is preferably provided.

FIGS. 3A to 3E

In the third variant of the suspension device, use is made of a trapezoidal profile bar 1, of which the broader front side 10 is located at the front. A grid of slots 3 is provided on the side flanks 11,12. The associated bracket 2, once again, has an encompassing part 20 with a top clamp portion 22, which can be plugged onto the profile bar 1 only on the level of a first pair of slots of the grid 3. The bottom supporting portion 23 of the encompassing part 20 strikes against the profile bar 1 outside a pair of slots of the grid 3 and thus cannot yet be pushed onto the profile bar 1. When the bracket 2 is moved downward, the encompassing part 20 passes, as it were, behind the widening front side 10 and is thus restrained. Once the bottom supporting portion 23 of the encompassing part 20 reaches a second pair of slots of the grid 3, the supporting portion 23 can be pushed in here, as a result of which the bracket 2 hanging on the profile bar 1 is provided with vertical support, while the clamp portion 22, which now encases the profile bar 1 outside a pair of slots, blocks the removal of the bracket 2 from the profile bar 1. The clamp portion 22 and the supporting portion 23 of the encompassing part 20 are spaced apart from one another by a distance which is not congruent with the distance between different pairs of slots for the grid 3.

FIGS. 4A to 4D

In the fourth variant of the suspension device, use is made of a cross-sectionally rectangular profile bar 1, on the rear side 13 of which is located a grid of slots 3 with horizontal through-slots and which is likewise intended for fastening on a carrying structure. The bracket 2 has the encompassing part 20 with the securing pin 24 which can be inserted transversely at the top. In the attached state, the encompassing part 20 engages around the front side 10 and the two side flanks 11,12 of the profile 1, and the securing pin 24 can be pushed in at a selected slot 3 of the grid 3. The bracket 2 rests on the front side 10 by way of the bottom supporting portion 23. In order to displace or release the bracket 2, the securing pin 24 has to be drawn out at least to the extent where the previously occupied slot 3 is completely freed.

FIGS. 5A to 5H

In the fifth variant, use is made of a T-shaped profile bar 1 which has its wider front side 10 oriented toward the front and has a grid of slots 3 on the two side flanks 11,12. A top clamp portion 22 with hooks 220 and a bottom supporting plate 23 are provided on the encompassing part 20 of the bracket 2, the clamp portion and supporting plate having fork-like openings which are directed toward the profile bar 1 and equal the span between a pair of slots, and are spaced apart from one another by a distance which is not congruent with the distance between different pairs of slots of the grid 3. The hooks 220 can be pushed over the profile bar 1 only on the level of the first pair of slots 3. Once the bracket 2 has been lowered or raised in a defined manner, the fork of the supporting portion 23 can be pushed into a second pair of slots 3, which is located beneath the first pair of slots 3.

FIGS. 6A to 6F

In the sixth variant, use is made of a cross-sectionally rectangular profile 1 which has a grid 3 of semicircular notches which is undercut in relation to the front side 10, on both sides, on the side flanks 11,12. The notches on the two side flanks 11,12 are symmetrical to one another and thus each form a pair of notches 3 located at the same height in each case. The bracket 2 has the encompassing part 20 with a clamp portion 22, on which are located securing plates 24 which are suspended in a moveable manner, have an eccentric center of gravity and thus position themselves of their own accord. When the bracket 2 is pushed onto the profile 1, the securing plates 24 rotate outward and, by virtue of the opening, thus allow the bracket 2 to be suspended on the profile 1 to the full extent. When the securing plates 24 pass into a selected pair of notches 3, the securing plates 24, utilizing the clearance, move downward into the undercut notches 3 and thus secure the bracket 2 on the profile 1. A reliable arresting action is achieved by particular shaping of the securing plates 24 and of the notches 3. If it is desired to detach the suspended bracket 2 from the profile 1, the bracket 2 has to be displaced vertically, with the result that the securing plates 24 move out of the previously occupied notches 3, open again as a result and now, for the first time, allow the bracket 2 to be removed from the profile 1.

FIGS. 7A to 7E

In the seventh variant, use is made of the same profile 1 as in the sixth variant. The bracket 2 is also very similar. Fixed in an eccentrically hanging state on the clamp portion 22 are approximately semicircular securing plates 24, there additionally being guided in slots and possibly being subjected to stressing by internal spring elements. The two securing plates 24 have inwardly facing noses which are intended for engaging in the undercut unit-spacing notch arrangement 3. When the bracket 2 is suspended on the profile 1, the securing plates 24 are forced outward and thus, in opened state, allow the bracket to be suspended on the profile 1. When the securing plates 24 come to a selected pair of notches 3, the securing plates 24 move downward, and their noses slide into the notches 3. By virtue of contouring on the noses, the bracket 2, even under loading, remains hanging on the profile 1. The disengagement of the bracket 2 is performed, in a manner analogous to the sixth variant, by the bracket 2 being moved upwardly and the opening of the securing plates 24 resulting therefrom.

Figure 8B:
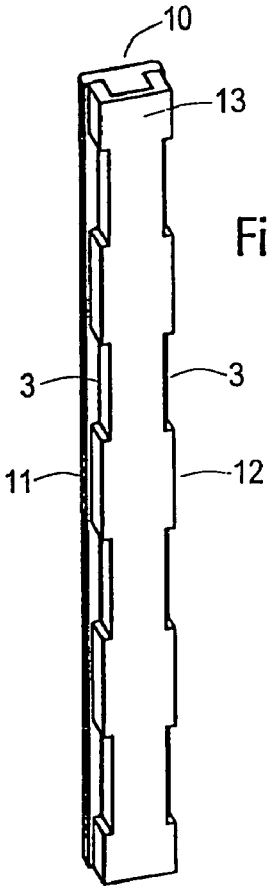
FIG. 8B shows the profile according to FIG. 8A.
Figure 8A:
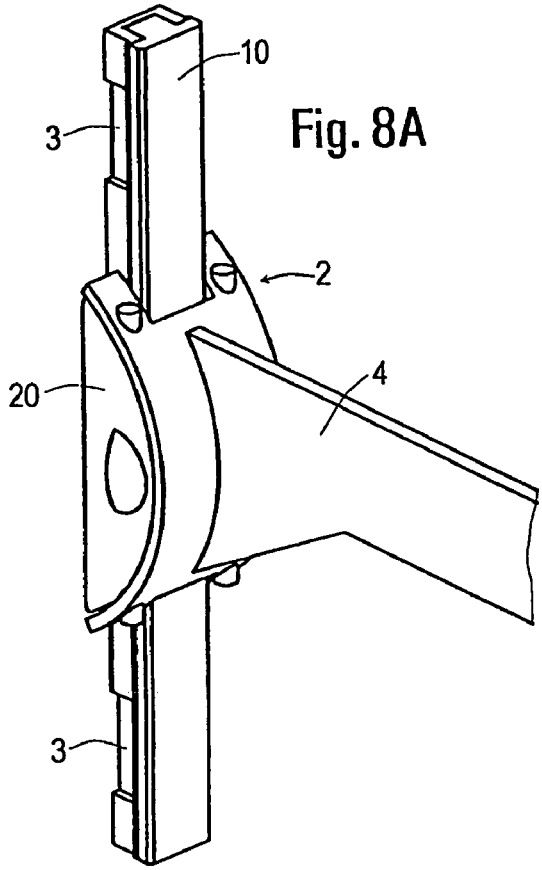
FIG. 8A shows a perspective illustration of an eighth variant of the suspension device, having a profile provided with a lateral, undercut grid of slots and having an associated bracket, in the suspended state.
Figure 8C:
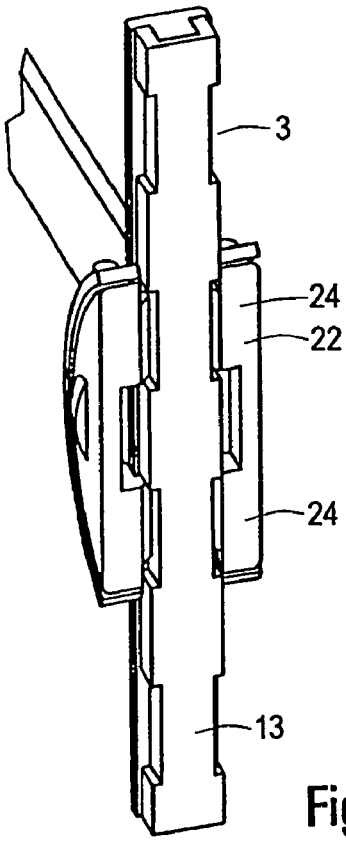
FIG. 8C shows a perspective view from the rear of the arrangement according to FIG. 8A.
Figure 8D:
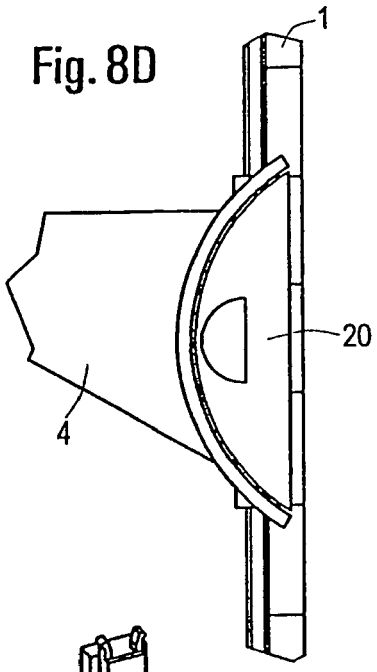
FIG. 8D shows a side view of the arrangement according to FIG. 8A.
Figure 8E:
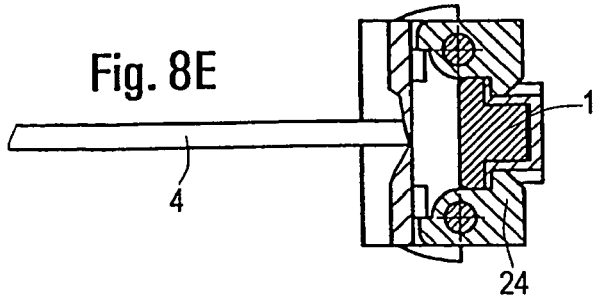
FIG. 8E shows the arrangement according to FIG. 8A in horizontal section.
Figure 8F:
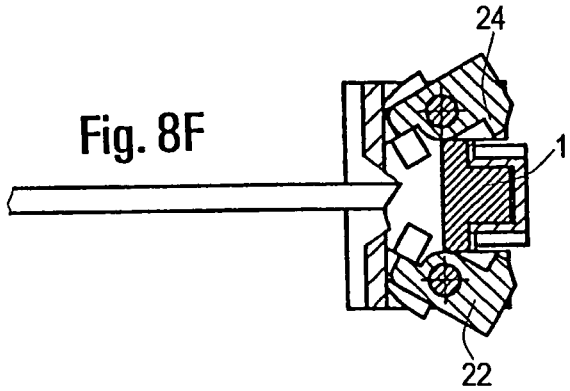
FIG. 8F shows the arrangement according to FIG. 8A, with the bracket disengaged from the profile, in horizontal section.
Figure 9B:
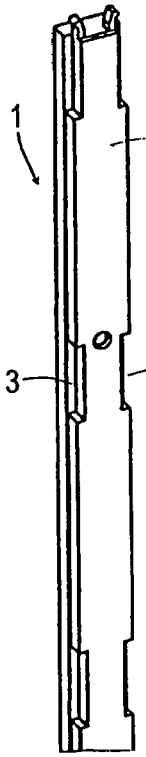
FIG. 9B shows the profile according to FIG. 9A.
Figure 9C:
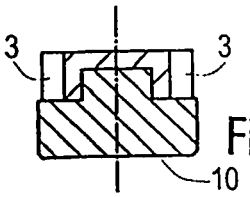
FIG. 9C shows the profile according to FIG. 9A in horizontal cross section.
Figure 9A:
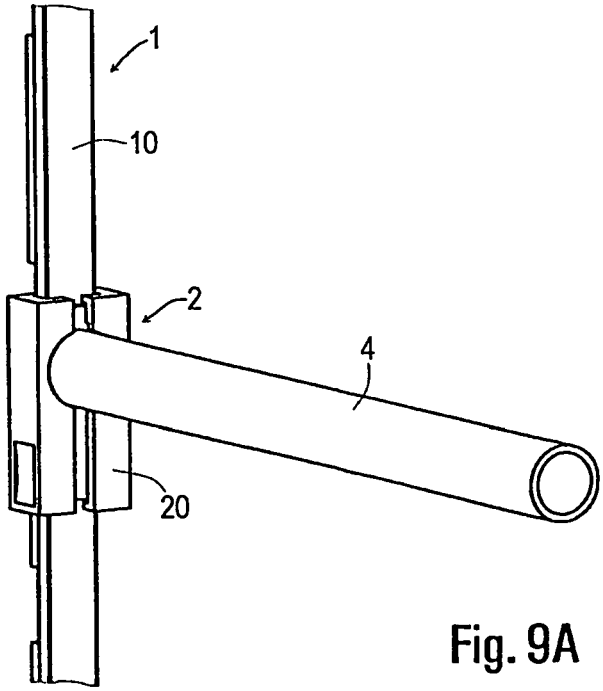
FIG. 9A shows a perspective illustration of a ninth variant of the suspension device, having a profile provided with a lateral, undercut grid of slots and having a modified bracket, in the suspended state.
Figure 10A:
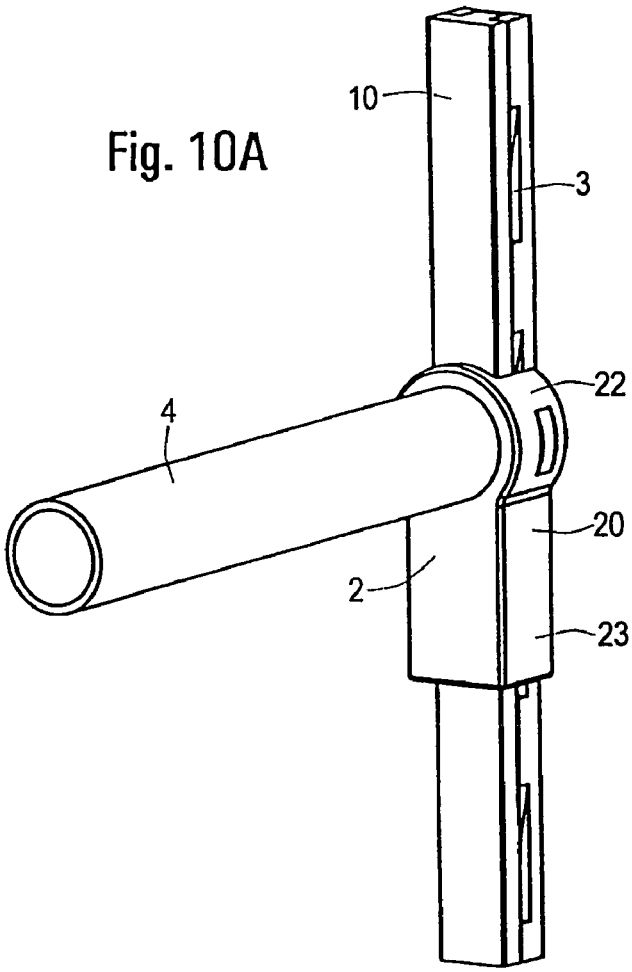
FIG. 10A shows a perspective illustration of a tenth variant of the suspension device, having a profile provided with a lateral, undercut grid of slots and having a modified bracket, in the suspended state.
Figure 10D:
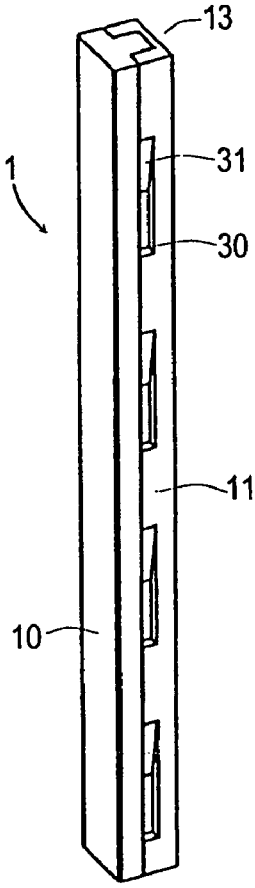
FIG. 10D shows the profile according to FIG. 10A.
Figure 10E:
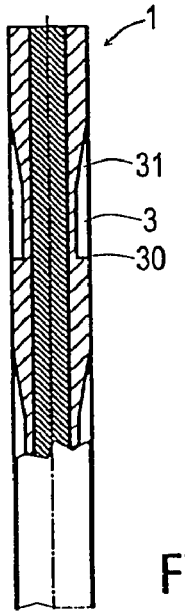
FIG. 10E shows the profile according to FIG. 10A in vertical section.
Figure 10F:
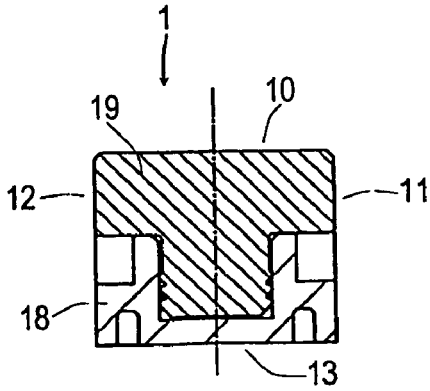
FIG. 10F shows an enlarged horizontal cross section of the profile according to FIG. 10G.
Figure 10L:
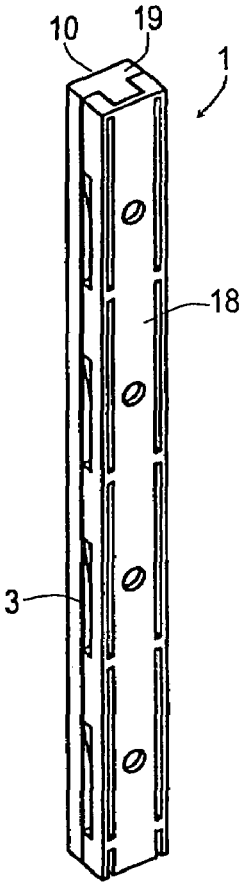
FIG. 10L shows a perspective view of the profile according to FIG. 10D at the rear.
Figure 10B:
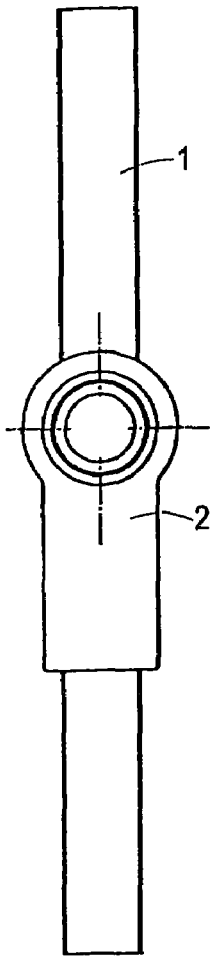
FIG. 10B shows a front view of the arrangement according to FIG. 10A.
Figure 10C:
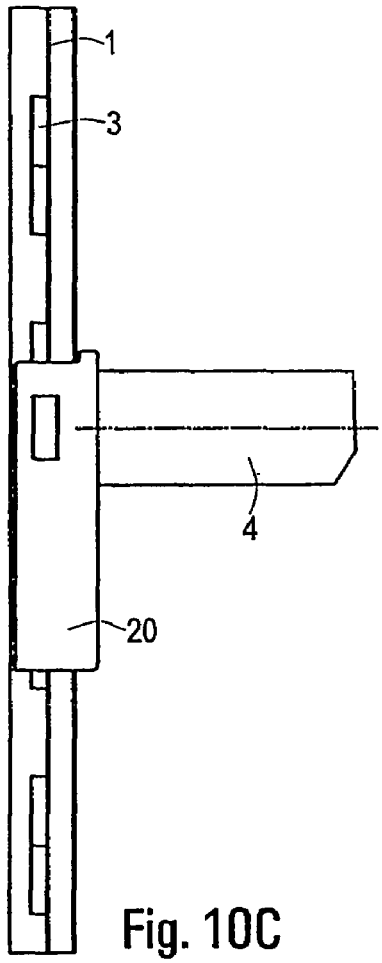
FIG. 10C shows a side view of the arrangement according to FIG. 10A.

FIGS. 8A to 8C

In the eighth variant, use is made, once again, of a profile 1 with an undercut grid of slots 3 on the two side flanks 11,12. This profile 1 is joined together from a rear strip, which forms the rear side 13 and contains the grid of slots 3, and a front strip, which forms the front side 10 and covers over the grid of slots 3 toward the front. The encompassing part 20 of the bracket 2 is designed as a spring-stressed gripper, which has two jaws and can be opened counter to the spring stressing, and the encompassing part 20 has mutually facing noses 24 as fixing elements 24 on its clamp portion 22. In the suspended state, the encompassing part 20 engages around the profile 1 and the spring stressing forces the noses 24 into a selected pair of slots 3, with the result that the bracket 2 is secured on the profile 1. In order to release the bracket 2 from the profile 1, or to displace it vertically thereon, the encompassing part 20 has to be opened counter to the prestressing of the spring, as a result of which the noses 24 move laterally out of the pair of slots 3. The gripper jaws are mounted in a rotatable manner on vertical pins.

FIGS. 9A to 9G

In the ninth variant of the device, use is made of basically the same profile 1, with a grid of slots 3 provided on the two side flanks 11,12, as in the eight variant. Here too, the encompassing part 20 of the bracket 2 is designed as a spring-stressed gripper which has two jaws and can be opened counter to the spring stressing. The fixing elements 24, once again, are mutually facing noses 24 which are provided on the clamp portion 22. In this case, however, the gripper jaws on the encompassing part 20 of the bracket 2 are mounted in a rotatable manner on horizontal pins, with the result that the top clamp portion 22 can be opened counter to the spring stressing. At the bottom region of the encompassing part 20, a corresponding amount of clearance is provided for the encompassing part 20 to move toward the profile 1 when the encompassing part is opened.

FIGS. 10A to 10L

In the tenth variant, use is made, once again, of a profile 1 with a grid of slots 3 which is undercut in relation to the front side 10. The grid of slots 3 is provided symmetrically on the two side flanks 11,12, this resulting in pairs of slots, which respective two slots are located at the same height. The slots 3, which are arranged systematically in pairs, have a ledge 30 at the bottom and, at the top, a slope 31 up to the plane of the side flanks 11,12. It is particularly advantageous to design the profile 1 in two parts, namely with a rear strip 18 made of plastic, in which the slots 3 can be made in an advantageous manner, and a front strip 19, which is made, for example, of aluminum and covers over the rear strip 18 to beyond the grid of slots 3, whereby the latter obtains its undercut contour. The two strips 18,19 are joined together in a form-fitting manner. An arrow marking on the rear strip 18, for example, could indicate the correct assembly direction. One configuration of the profile 1 is provided for screw connection at the rear—through the rear strip 18—(see FIGS. 10F to 10H). Another configuration of the profile 1 serves for screw connection at the front—through the front strip 19—in which case a covering strip 19' is provided for covering the screw holes and heads (see FIGS. 10I to 10K). The bracket 2 with the load carrier 4 attached thereto, once again, has an encompassing part 20 with the top clamp portion 22 and the supporting portion 23 extending downward therebeneath.

FIGS. 11A to 14C

The bracket 2 has a U-shaped, vertically extending aperture, which is complementary to the cross section of the profile 1, in order to receive the profile 1 with its front side 10 and its two side flanks 11,12, when the bracket 2 is suspended in the profile 1. In the top clamp portion 22 of the bracket 2, wedges 50 are inserted on either side of the aperture, these wedges 50 being mounted on springs 5, being moveable to a limited extent to the side and being provided for elastic engagement in a selected pair of slots 3. As a result of the springs 5, the wedges 50, the tips of which project into the aperture in the rest position, are prestressed toward one another. The wedges 50 and springs 5 are separate components which—inserted in cutouts in the clamp portion 22—secure one another.

If the bracket 2 has been suspended correctly and in a load-bearing manner at a selected height in the profile 1—this state is defined as the latching position—the wedges 50 advanced by the springs 5 project into the pair of slots 3 and are seated on the ledges 30 of the two slots 3. The vertical load component which is acting from the suspended bracket 2 on the carrying profile 1 is absorbed by the wedges 50 engaging in the pair of slots 3. The downwardly oriented oblique load component is absorbed by the supporting portion 23 and the sides of the wedges 50. The wedges 50 have been moved largely toward one another and a downward movement of the bracket 2 is blocked (see FIGS. 11C, 12A and 12B).

The sliding position (see FIGS. 13A and 13B) give the position assumed by the bracket 2 before it is moved into the latching position or as it is moved out of the latter. If the bracket 2 hanging on the profile 1 is raised upwardly, the wedges 50 begin to move up along the slopes 31 of the occupied pair of slots 3 and thereby, forced outward counter to the stressing of the springs 5, are quasi gradually opened when moving up and leaving the pair of slots 3.

As the bracket 2 suspended in the profile 1 moves up further, and thus leaves the originally occupied pair of slots 3 to an increasing extent, the free position of the bracket 2 is finally reached (see FIGS. 11D, 14A to 14C). The wedges 50 have moved completely out of the pair of slots 3, have reached the maximum opening between them and are now seated on the side flanks 11,12 of the profile 1. Here, the bracket 2 can be removed from the profile 1, and pushed further upward or downward again until it latches anew in the originally occupied pair of slots 3.

Figure 11A:
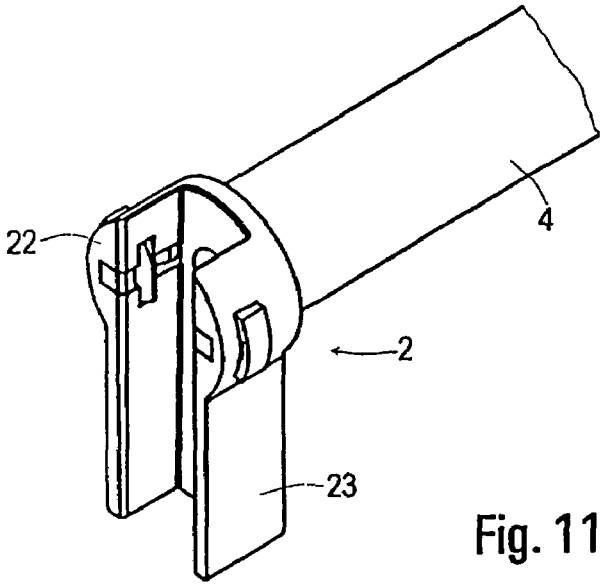
FIG. 11A shows a perspective view from the rear of the bracket according to FIG. 10A.
Figure 12A:
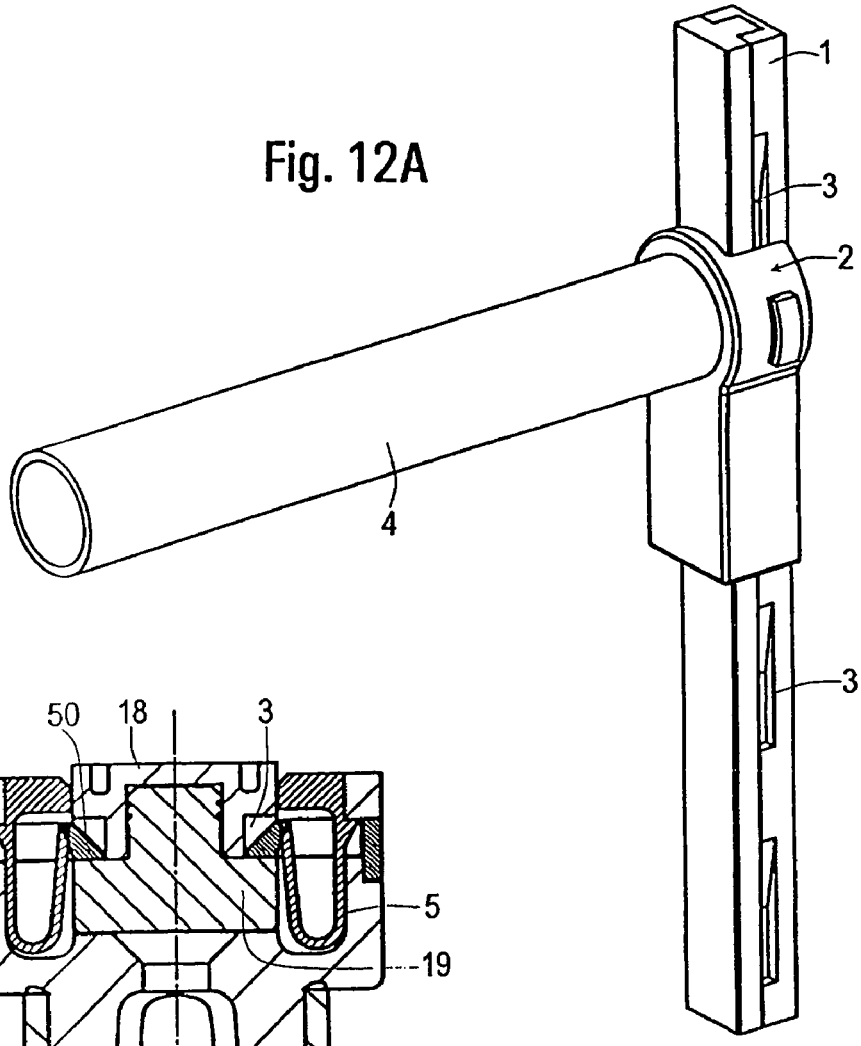
FIG. 12A shows a perspective illustration of the arrangement according to FIG. 10A in the latching position.
Figure 12B:
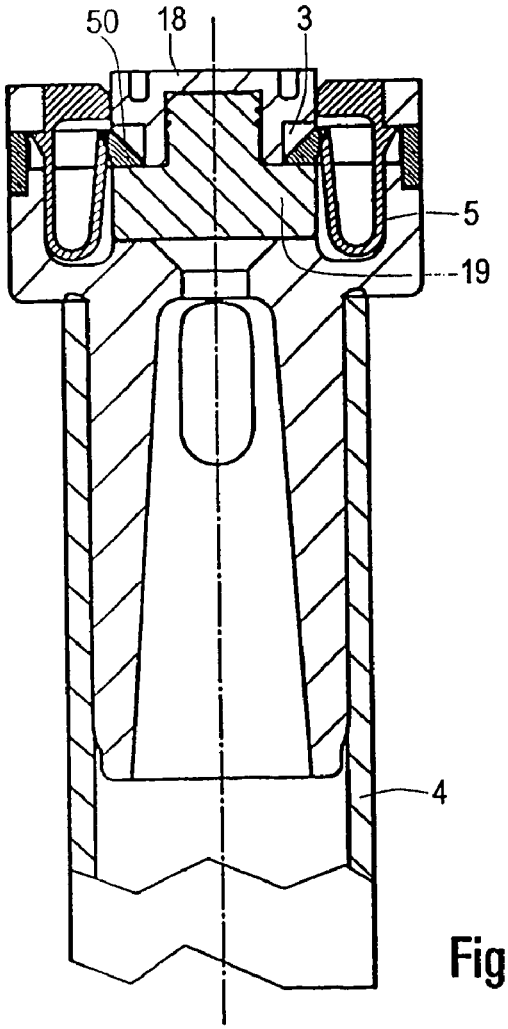
FIG. 12B shows an enlarged horizontal section of the arrangement according to FIG. 12A.
Figure 13B:
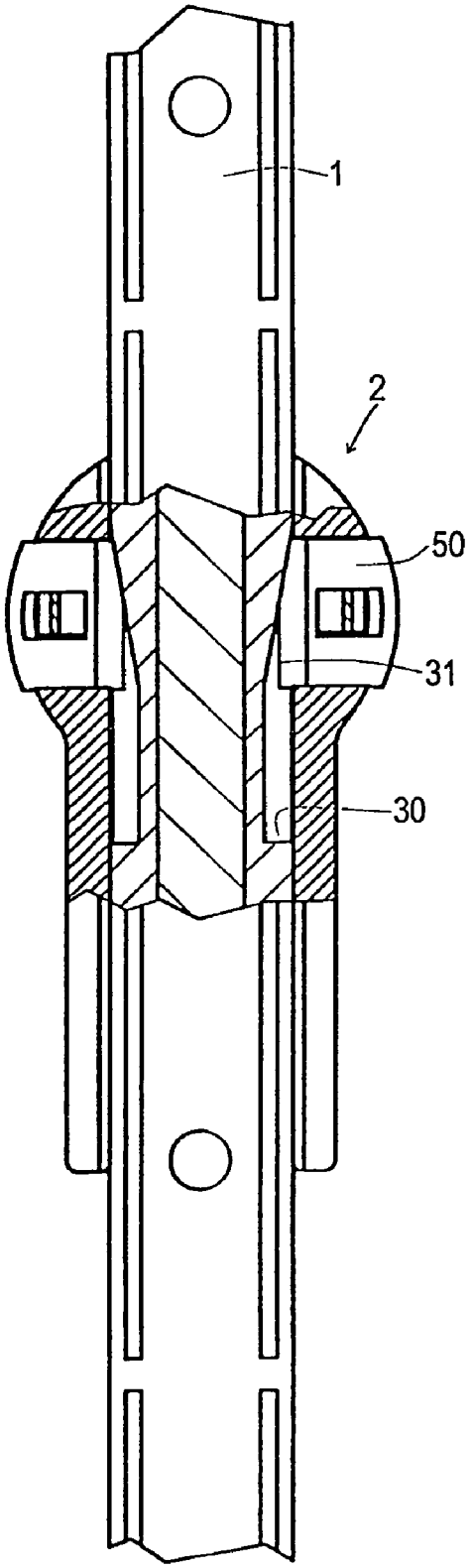
FIG. 13B shows the arrangement according to FIG. 13A in vertical section.
Figure 13A:
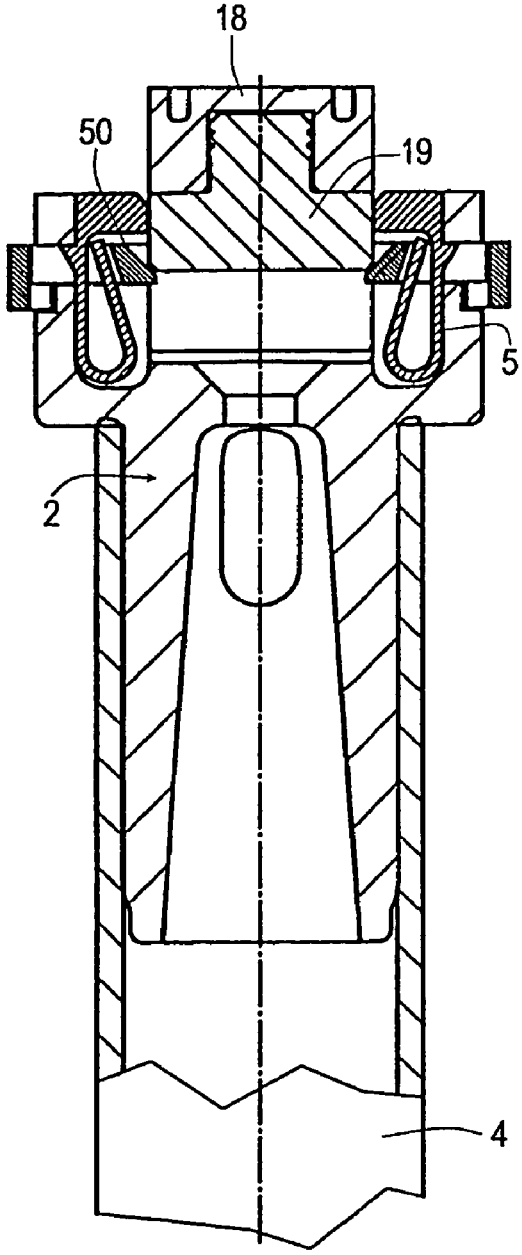
FIG. 13A shows an enlarged horizontal section of the arrangement according to FIG. 10A in the sliding position.
Figure 16A:
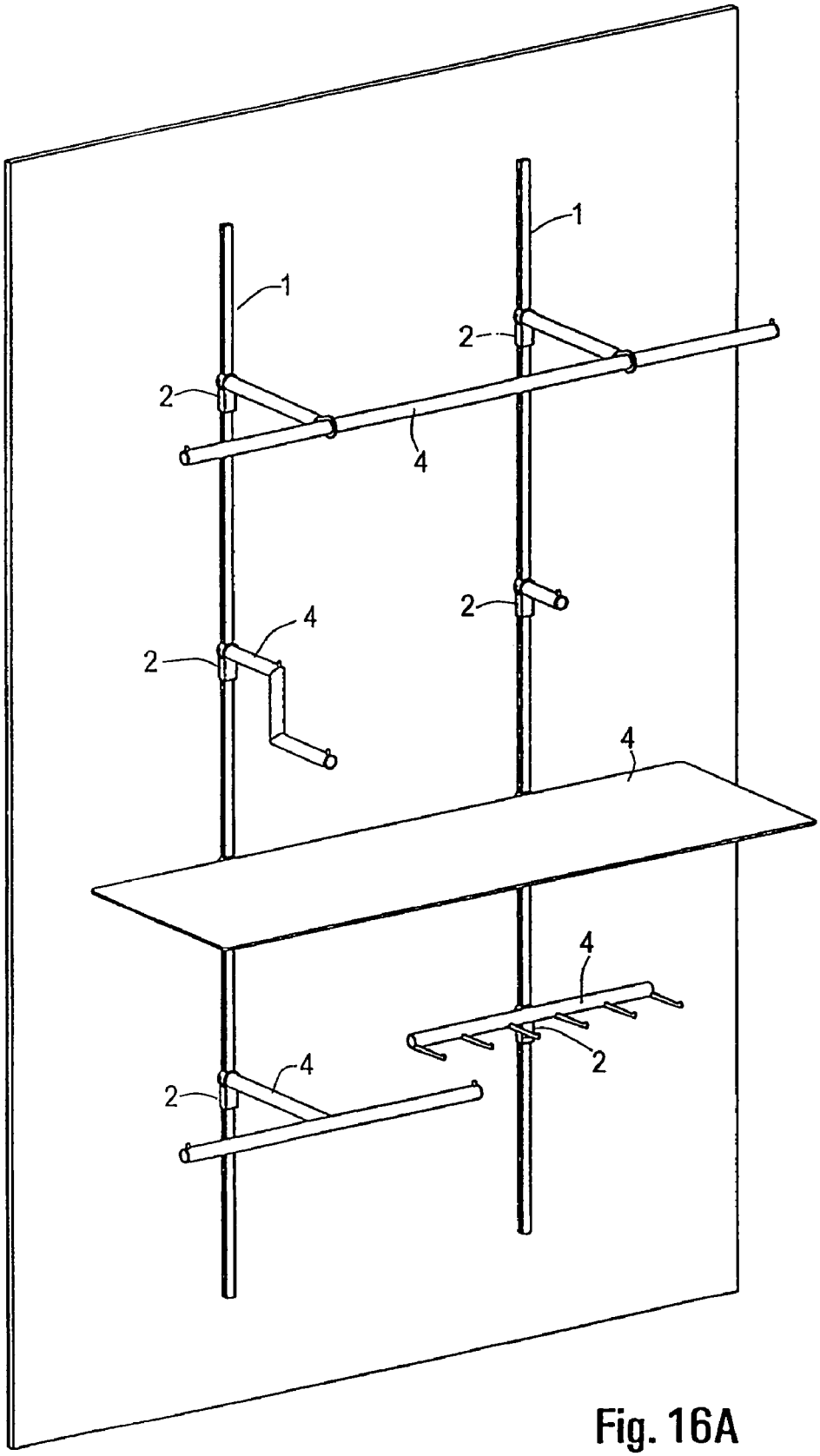
FIG. 16A shows a panel with the tenth variant of the suspension device, according to FIG. 10A, and differently configured load carriers.
Figure 16B:
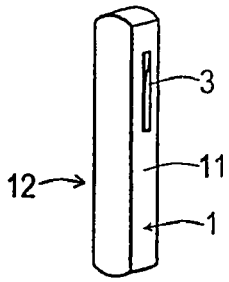
FIG. 16B shows a length of profile of the tenth variant with pair of latching grooves.
Figure 16C:
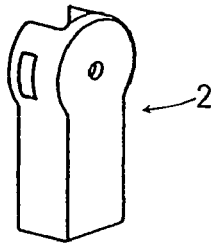
FIG. 16C shows a universal bracket according to 15A.
Figure 16D:
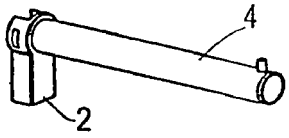
FIG. 16D shows a bracket with a straight carrying arm.
Figure 16E:
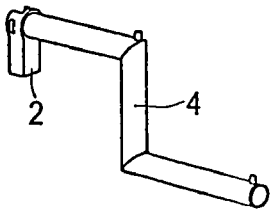
FIG. 16E shows a bracket with a stepped carrying arm.
Figure 16F:
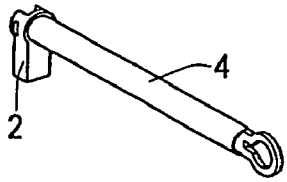
FIG. 16F shows a bracket with a carrying arm for accommodating a crossbar.
Figure 16G:
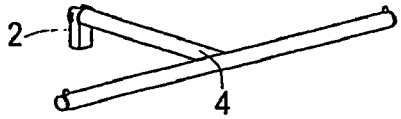
FIG. 16G shows a bracket with a T-shaped carrying arm.
Figure 16H:
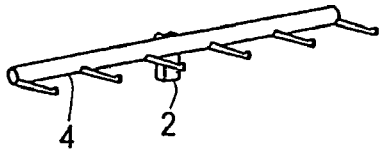
FIG. 16H shows a bracket with a hook rail.
Figure 16I:
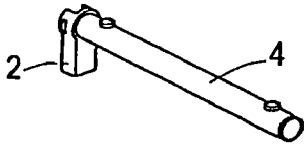
FIG. 16I shows a bracket with shelf mounts.

In the separated position, the bracket 2 has been removed from the profile 1; the wedges 50 have been moved all the way into the limit position in the aperture by the springs 5 and are now spaced apart from one another by the smallest distance (see FIG. 11A). Bevels on the wedges 50 allow the bracket 2 to be suspended at any height position in the profile 1.

FIGS. 15A to 16I

The profile 1 which is made up of the rear strip 18, with the grid of slots 3, and the front strip 19 is regarded as being particularly advantageous. The bracket 2 which is shown hanging on the profile 1 in FIGS. 15A to 15C can be combined with differently configured load carriers 4, as illustrated in FIGS. 16A and 16D to 16I.

For specific configurations and applications, short lengths of the profile 1 can be fastened on a carrying structure. Such lengths have at least one pair of slots 3 located opposite one another. It is also possible for the brackets 2 to be suspended on such lengths of profile 1, a vertical height displacement being dispensed with here (see FIGS. 16B and 16C).

What is claimed is:

1. A suspension device comprising:

a) a profile (1) which is to be arranged vertically and has a front side (10), two side flanks (11,12), a rear side (13) and engagement contours (3) provided on the profile (1); and b) a bracket (2) which can be suspended on the profile (1) and has fixing elements (50) which are complementary to the engagement contours (3); wherein c) the bracket (2) has an encompassing part (20) in which the fixing elements (50) are arranged, d) the bracket (2) encases the front side (10) and the side flanks (11,12) of the profile (1), e) the fixing elements (50) at a clamp portion (22) of the encompassing part (20) of the bracket (2) include elements (50) mounted on a spring (5), and f) the engagement contours (3) in the profile (1) are arranged in the side flanks (11,12) of the profile (1) and are closed to the front side (10) such that the engagement contours (3) are not arranged in the front side (10), wherein the engagement contours (3) are designed as wedge-shaped slots (3) in the side flanks (11,12), have a ledge (30) at the bottom and slope up gradually to a plane defined by the side flanks (11,12).

2. A suspension device comprising:

a) a profile (1) which is to be arranged vertically and has a front side (10), two side flanks (11,12), a rear side (13) and engagement contours (3) provided on the profile (1); and b) a bracket (2) which can be suspended on the profile (1) and has fixing elements (50) which are complementary to the engagement contours (3); wherein c) the bracket (2) has an encompassing part (20) in which the fixing elements (50) are arranged, d) the bracket (2) encases the front side (10) and the side flanks (11,12) of the profile (1), e) the fixing elements (50) at a clamp portion (22) of the encompassing part (20) of the bracket (2) include elements (50) mounted on a spring (5), f) the engagement contours (3) in the profile (1) are arranged in the side flanks (11,12) of the profile (1) and are recesses which are closed to the front side (10), g) the engagement contours (3) on one of the side flanks (11) are arranged symmetrically in relation to the engagement contours (3) on another one of the side flanks (12), the engagement contours (3) being designed as wedge-shaped slots (3) in the side flanks (11,12), have a ledge (30) at the bottom and slope up gradually to a plane defined by the side flanks (11,12), h) the fixing elements (50) in the bracket (2) are wedges (50) and springs (5), the wedges (50) being mounted on the springs (5), one of the springs (5) and a corresponding one of the wedges (50) being provided on a first side of an aperture receiving the profile (1), and anotherone of the springs (5) and a corresponding one of the wedges (50) being provided on a second side of the aperture receiving the profile (1), and i) the springs (5) and the wedges (50), inserted in cutouts, secure one another.

3. A suspension device comprising:

a) a profile (1) which is to be arranged vertically and has a front side (10), two side flanks (11,12), a rear side (13) and engagement contours (3) provided on the profile (1); and b) a bracket (2) which can be suspended on the profile (1) and has fixing elements (50) which are complementary to the engagement contours (3); wherein c) the bracket (2) has an encompassing part (20) in which the fixing elements (50) are arranged;

d) the bracket (2) encases the front side (10) and the side flanks (11,12) of the profile (1), e) the fixing elements (50) at a clamp portion (22) of the encompassing part (20) of the bracket (2) are arranged as elastic elements (50), f) the engagement contours (3) in the profile (1) are arranged in the side flanks (11,12) of the profile (1) and are recesses which are closed to the front side (10), g) the engagement contours (3) on one of the side flanks (11) are arranged symmetrically in relation to the engagement contours (3) on another one of the side flanks (12), the engagement contours (3) being designed as wedge-shaped slots (3) in the side flanks (11,12), have a ledge (30) at the bottom and slope up gradually to a plane defined by the side flanks (11,12), h) the fixing elements (50) in the bracket (2) are wedges (50) and springs (5), the wedges (50) being mounted on the springs (5), one of the springs (5) and a corresponding one of the wedges (50) being provided on a first side of an aperture receiving the profile (1), and another one of the springs(5) and a corresponding one of the wedges (50) being provided on a second side of the aperture receiving the profile (1), and i) the springs (5) and the wedges (50), inserted in cutouts, secure one another.

4. The suspension device as claimed in one of claim 1 or 3, wherein the wedge-shaped slots (3) in the side flanks (11,12) slope up gradually in a slanting plane (31) to a plane defined by the side flanks (11,12).

5. The suspension device as claimed in one of claim 2 or 3 wherein the profile (1) is used as bar material.

6. The suspension device as claimed in one of claim 2 or 3 18 wherein the profile (1) is used in short lengths with at least one pair of engagement contours (3).

7. The suspension device as claimed in claim 1, wherein the profile (1) is used as bar material.

8. The suspension device as claimed in claim 1, wherein the profile (1) is used in short lengths with at least one pair of engagement contours (3).

* * * * *

UNITED STATES PATENT AND TRADEMARK OFFICE

CERTIFICATE OF CORRECTION

PATENT NO. : 7,571,882 B2
APPLICATION NO. : 10/495296
DATED : August 11, 2009
INVENTOR(S) : Herbert Walter It is certified that error appears in the above-identified patent and that said Letters Patent is hereby corrected as shown below:

In Column 11, line 35, "anotherone" should read --another one--.

In Column 12, line 38, "18" should be deleted.

Signed and Sealed this

Twenty-second Day of December, 2009

David J. Kappos

David J. Kappos
*Director of the United States Patent and Trademark Office*